US006755263B2

(12) United States Patent
Alft et al.

(10) Patent No.: US 6,755,263 B2
(45) Date of Patent: Jun. 29, 2004

(54) UNDERGROUND DRILLING DEVICE AND METHOD EMPLOYING DOWN-HOLE RADAR

(75) Inventors: Kevin L. Alft, Pella, IA (US); Brian J. Bischel, Hartland, WI (US); Gregg A. Austin, Pella, IA (US); Hans Kelpe, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 10/283,006

(22) Filed: Oct. 29, 2002

(65) Prior Publication Data

US 2003/0056983 A1 Mar. 27, 2003

Related U.S. Application Data

(62) Division of application No. 09/955,675, filed on Sep. 19, 2001, now Pat. No. 6,470,976, which is a division of application No. 09/405,889, filed on Sep. 24, 1999, now Pat. No. 6,308,787.

(51) Int. Cl.[7] ..... E21B 7/04
(52) U.S. Cl. ..... 175/61
(58) Field of Search ..... 175/26, 38, 73, 175/27, 42, 40, 48, 76, 50, 61; 73/153, 152.95, 155; 342/22; 166/66.4; 340/853.1, 853.3, 853.4; 702/6, 7, 9

(56) References Cited

U.S. PATENT DOCUMENTS

| | | | |
|---|---|---|---|
| 3,578,092 | A | 5/1971 | Jurgen et al. |
| 3,942,594 | A | 3/1976 | Smith et al. |
| 4,224,988 | A | 9/1980 | Gibson et al. |
| 4,269,569 | A | 5/1981 | Hoover |
| 4,297,699 | A | 10/1981 | Fowler et al. |
| 4,413,511 | A | 11/1983 | Godbey |
| 4,430,653 | A | 2/1984 | Coon et al. |
| 4,430,892 | A | 2/1984 | Owings |
| 4,492,865 | A | 1/1985 | Murphy et al. |
| 4,686,475 | A | 8/1987 | Kober et al. |
| 4,703,664 | A | 11/1987 | Kirkpatrick et al. |
| 4,814,768 | A | 3/1989 | Chang |
| 4,823,888 | A | 4/1989 | Smet |
| 4,896,116 | A | 1/1990 | Nagashima et al. |
| 4,907,658 | A | 3/1990 | Stangl et al. |
| 5,306,909 | A | 4/1994 | Jones et al. |
| 5,325,095 | A | 6/1994 | Vadnais et al. |
| 5,337,002 | A | 8/1994 | Mercer |
| 5,339,080 | A | 8/1994 | Steinway et al. |
| 5,469,155 | A | 11/1995 | Archambeault et al. |
| 5,474,142 | A | 12/1995 | Bowden |
| 5,499,029 | A | 3/1996 | Bashforth et al. |
| 5,553,407 | A | 9/1996 | Stump |
| 5,556,253 | A | 9/1996 | Rozendaal et al. |
| 5,585,726 | A | 12/1996 | Chau |
| 5,616,842 | A | 4/1997 | Armengaud et al. |
| 5,633,589 | A | 5/1997 | Mercer |
| 5,659,985 | A | 8/1997 | Stump |
| 5,698,981 | A | 12/1997 | Mercer |
| 5,704,142 | A | 1/1998 | Stump |
| 5,720,354 | A | 2/1998 | Stump et al. |
| 5,746,278 | A | 5/1998 | Bischel |
| 5,757,320 | A | 5/1998 | McEwan |
| 5,764,062 | A | 6/1998 | Mercer |
| 5,767,678 | A | 6/1998 | Mercer |

(List continued on next page.)

FOREIGN PATENT DOCUMENTS

| | | |
|---|---|---|
| DE | 39 11 469 A1 | 10/1990 |
| DE | 42 30 624 A1 | 3/1994 |

*Primary Examiner*—Robert E. Pezzuto
(74) *Attorney, Agent, or Firm*—Crawford Maunu PLLC

(57) ABSTRACT

Systems and methods for sensing at an underground drilling device in communication with an above-ground locator involve transmitting a radar probe signal from the underground drilling device. A radar return signal is received at the underground drilling device. The radar return signal is processed at the underground drilling device to produce sensor data. The sensor data is transmitted in a form suitable for reception by the above-ground locator.

32 Claims, 17 Drawing Sheets

U.S. PATENT DOCUMENTS 5,769,503 A 6/1998 Stolarczyk et al.
5,774,091 A 6/1998 McEwan
5,805,110 A 9/1998 McEwan
5,813,480 A 9/1998 Zaleski, Jr. et al.
5,819,859 A 10/1998 Stump et al.
5,842,149 A 11/1998 Harrell et al.
5,867,117 A 2/1999 Gogineni et al.
5,904,210 A 5/1999 Stump et al.
5,907,242 A 5/1999 Gard
5,933,014 A 8/1999 Hartrumpf et al.
5,937,954 A 8/1999 Puttmann et al.
5,944,121 A 8/1999 Bischel et al.
6,012,536 A 1/2000 Puttmann et al.
6,035,951 A 3/2000 Mercer et al.
6,047,783 A 4/2000 Mercer et al.
6,057,687 A 5/2000 Mercer
6,079,506 A 6/2000 Mercer
6,088,294 A 7/2000 Leggett, III et al.
6,095,260 A 8/2000 Mercer et al.
6,199,643 B1 3/2001 Hesse et al.
6,308,787 B1 10/2001 Alft et al.
6,315,062 B1 11/2001 Alft et al.
6,389,360 B1 5/2002 Alft et al.

UNDERGROUND DRILLING DEVICE AND METHOD EMPLOYING DOWN-HOLE RADAR

This application is a divisional of Ser. No. 09/955,675, filed Sep. 19, 2001, now U.S. Pat. No. 6,470,976 which is a divisional of Ser. No. 09/405,889, filed Sep. 24, 1999, now U.S. Pat. No. 6,308,787 which are hereby incorporated by reference herein.

BACKGROUND OF THE INVENTION

The present invention relates generally to the field of underground boring and, more particularly, to underground sensing at a cutting tool using down-hole radar.

Utility lines for water, electricity, gas, telephone and cable television are often run underground for reasons of safety and aesthetics. In many situations, the underground utilities can be buried in a trench which is then back-filled. Although useful in areas of new construction, the burial of utilities in a trench has certain disadvantages. In areas supporting existing construction, a trench can cause serious disturbance to structures or roadways. Further, there is a high probability that digging a trench may damage previously buried utilities, and that structures or roadways disturbed by digging the trench are rarely restored to their original condition. Also, an open trench poses a danger of injury to workers and passersby.

The general technique of boring a horizontal underground hole has recently been developed in order to overcome the disadvantages described above, as well as others unaddressed when employing conventional trenching techniques. In accordance with such a general horizontal boring technique, also known as microtunnelling, horizontal directional drilling (HDD) or trenchless underground boring, a boring system is situated on the ground surface and drills a hole into the ground at an oblique angle with respect to the ground surface. A drilling fluid is typically flowed through the drill string, over the boring tool, and back up the borehole in order to remove cuttings and dirt. After the boring tool reaches a desired depth, the tool is then directed along a substantially horizontal path to create a horizontal borehole. After the desired length of borehole has been obtained, the tool is then directed upwards to break through to the surface. A reamer is then attached to the drill string which is pulled back through the borehole, thus reaming out the borehole to a larger diameter. It is common to attach a utility line or other conduit to the reaming tool so that it is dragged through the borehole along with the reamer.

In order to provide for the location of a boring tool while underground, a conventional approach involves the incorporation of an active sonde disposed within the boring tool, typically in the form of a magnetic field generating apparatus that generates a magnetic field. A receiver is typically placed above the ground surface to detect the presence of the magnetic field emanating from the boring tool. The receiver is typically incorporated into a hand-held scanning apparatus, not unlike a metal detector, which is often referred to as a locator. The boring tool is typically advance by a single drill rod length after which boring activity is temporarily halted. An operator then scans an area above the boring tool with the locator in an attempt to detect the magnetic field produced by the active sonde situated within the boring tool. The boring operation remains halted for a period of time during which the boring tool data is obtained and evaluated. The operator carrying the locator typically provides the operator of the boring machine with verbal instructions in order to maintain the boring tool on the intended course.

It can be appreciated that present methods of detecting and controlling boring tool movement along a desired underground path is cumbersome, fraught with inaccuracies, and require repeated halting of boring operations. Moreover, the inherent delay resulting from verbal communication of course change instructions between the operator of the locator and the boring machine operator may compromise tunneling accuracies and safety of the tunneling effort. By way of example, it is often difficult to detect the presence of buried objects and utilities before and during tunneling operations. In general, conventional boring systems are unable to quickly respond to needed boring tool direction changes and productivity adjustments, which are often needed when a buried obstruction is detected or changing soil conditions are encountered.

During conventional horizontal and vertical drilling system operations, the skilled operator is relied upon to interpret data gathered by various down-hole information sensors, modify appropriate controls in view of acquired down-hole data, and cooperate with other operators typically using verbal communication in order to accomplish a given drilling task both safely and productively. In this regard, such conventional drilling systems employ an "openloop" control scheme by which the communication of information concerning the status of the drill head and the conversion of such drill head status information to drilling machine control signals for effecting desired changes in drilling activities requires the presence and intervention of an operator at several points within the control loop. Such dependency on human intervention within the control loop of a drilling system generally decreases overall excavation productivity, increases the delay time to effect necessary changes in drilling system activity in response to acquired drilling machine and drill head sensor information, and increases the risk of injury to operators and the likelihood of operator error.

There exists a need in the excavation industry for an apparatus and methodology for controlling an underground boring tool and boring machine with greater responsiveness and accuracy than is currently attainable given the present state of the technology. There exists a further need for such an apparatus and methodology that may be employed in vertical and horizontal drilling applications. The present invention fulfills these and other needs.

SUMMARY OF THE INVENTION

The present invention is directed to systems and methods for down-hole sensing using radar. According to one embodiment, an underground drilling device is implemented for use with an above-ground locator. The underground drilling device includes a cutting tool assembly comprising a cutting tool and a sensor housing. A radar unit is provided in the sensor housing. A transmitter is also provided in the sensor housing. A processor, provided in the sensor housing and communicatively coupled to the radar unit and the transmitter, receives radar data from the radar unit and produces sensor data for transmission via the transmitter in a form suitable for reception by the above-ground locator.

According to another embodiment, a method of sensing at an underground drilling device in communication with an above-ground locator involves transmitting a radar probe signal from the underground drilling device. A radar return signal is received at the underground drilling device. The radar return signal is processed at the underground drilling device to produce sensor data. The sensor data is transmitted in a form suitable for reception by the above-ground locator.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
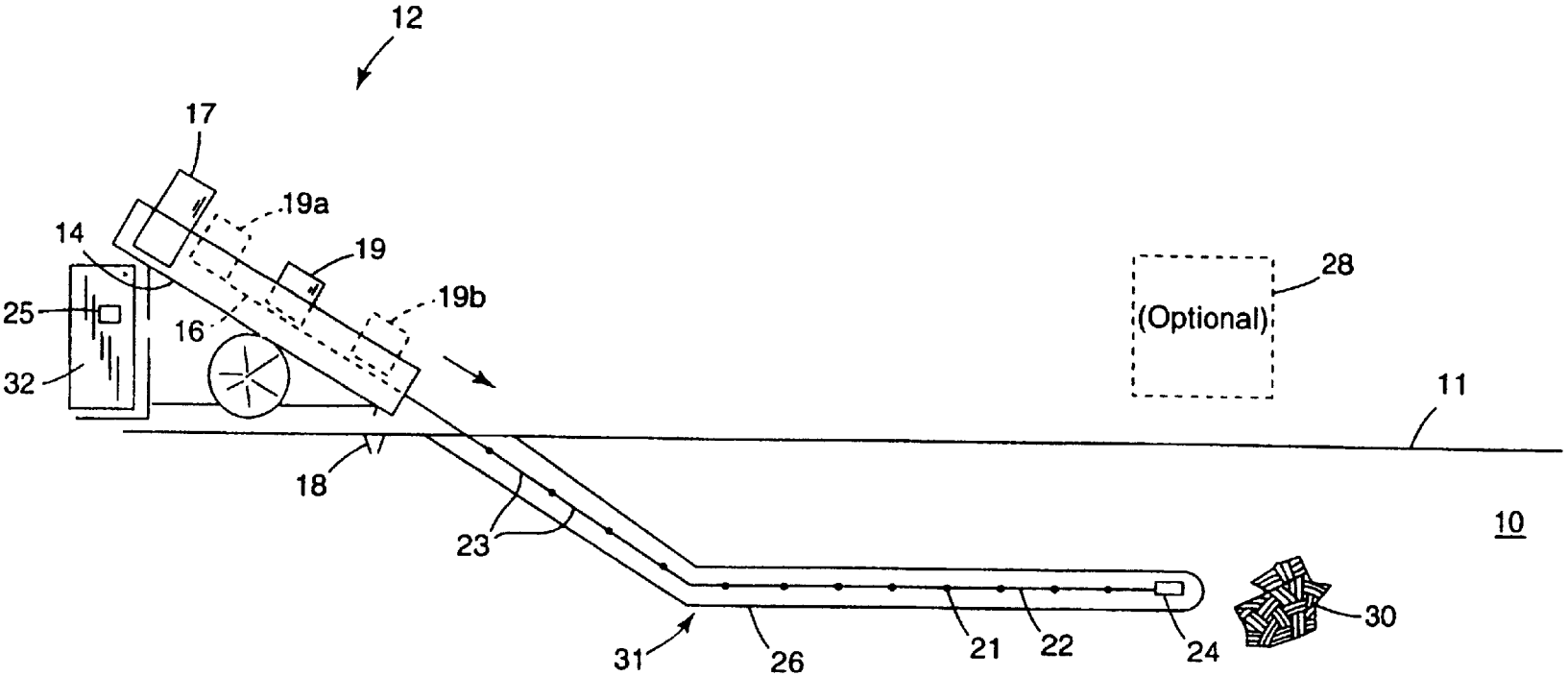
FIG. 1 is a side view of an underground boring apparatus in accordance with an embodiment of the present invention.

While the invention is amenable to various modifications and alternative forms, specifics thereof have been shown by way of example in the drawings and will be described in detail hereinbelow. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF VARIOUS EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

Referring now to the figures and, more particularly, to FIG. 1, there is illustrated an embodiment of an underground boring system which incorporates a closed-loop system and methodology for controlling a boring machine and an underground boring tool in real-time according to the principles of the present invention. Real-time control of a boring machine and boring tool progress during a drilling operation provides for a number of advantages previously unrealizable using conventional boring control system approaches. The location of the boring tool is monitored on a continuous basis and boring tool location information is transmitted to a computer or processor at the boring machine.

The boring tool is equipped with a down-hole electronics unit which houses a number of sensors, related circuitry, and preferably a battery unit. The boring tool is provided with a beacon or sonde that produces an electromagnetic signal which may be detected using an aboveground tracker unit or receiver. Various sensors provided in the down-hole electronics unit and elsewhere at the boring tool produce output signals which may be communicated to the tracker unit as a modulated boring tool signal emitted by the sonde. Alternatively, boring tool sensor data may be communicated to the boring machine via a drill string communication link and, if desired, from the boring machine to the tracker unit via a wire or wireless communication link.

In one embodiment, the boring tool is provided with magnetic field sensors that sense variations in the magnetic field proximate the boring tool. The boring tool may further incorporate an antenna which is sensitive to an electromagnetic signal produced aboveground, such as by the tracker unit or a bore path target. The magnetic field sensors may be incorporated in a magnetometer, which may be a multiple-axis (e.g., three-axis) magnetometer. Such variations in the local magnetic field proximate the boring tool typically arise from the presence of nearby ferrous material within the earth, and may also arise from nearby current carrying underground conductors. Iron-based metals within the earth, for example, may have significant magnetic permeability which distorts the earth's magnetic filed in the excavation area. Depending on the particular mode of operation, such ferrous material may produce undesirable residual magnetic fields which can negatively affect the accuracy of a given measurement if left undetected.

A magnetometer sense circuit of the boring tool may be sensitive to both AC and DC fields. For example, magnetometer sense circuits that are sensitive to DC fields may be used for purposes of detecting changes in the earth's magnetic field, typically resulting from the presence of ferrous materials in the earth. Magnetometer sense circuits that are sensitive to AC fields may be used for purposes of detecting nearby utilities.

The boring tool may further include a multiple-axis accelerometer, such as a three-axis accelerometer. Examples of various sensor and instrument arrangements which may be implemented within or proximate the boring tool are disclosed in U.S. Pat. Nos. 5,767,678; 5,764,062; 5,698,981; 5,633,589; 5,469,155; 5,337,002; and 4,907,658; all of which are hereby incorporated herein by reference in their respective entireties.

A boring tool may be further equipped with an on-board radar unit, such as a ground penetrating radar (GPR) unit. The boring tool may also include one or more geophysical sensors, including a capacitive sensor, acoustic sensor, ultrasonic sensor, seismic sensor, resistive sensor, and electromagnetic sensor, for example. One state-of-the-art GPR system which may be incorporated into boring tool housings of varying sizes is implemented in an integrated circuit package. Use of a down-hole GPR system provides for the detection of nearby buried obstacles and utilities, and characterization of the local geology. Some or all of the GPR data may be processed by a signal processor provided within the boring tool or by/in combination with an above-ground signal processor, such as a signal processor provided in a hand-held or otherwise portable tracker unit or, alternatively, a signal processor provided at the boring machine. The GPR unit may alternatively be provided in the hand-held/portable tracker unit or in both the boring tool and the hand-held/portable tracker unit.

By way of example, a ground penetrating radar integrated circuit (IC) or chip may be employed as part of the down-hole electronics. The GP-radar IC may be employed to perform subsurface surveying, object detection and avoidance, geologic imaging, and geologic characterization, for example. The GP-radar IC may implement several different detection methodologies, several of which will be describe hereinbelow. A suitable GP-radar IC is manufactured by the Lawrence Livermore National Laboratory and is identified as the micropower-impulse radar (MIR). The MIR device is a low cost radar system on a chip that uses conventional electronic components. The radar transmitter and receiver are contained in a package measuring approximately two square inches. The microradar is expected to be further reduced to the size of a silicon microchip. Other suitable radar IC's and detection methodologies are disclosed in U.S. Pat. Nos. 5,805,110; 5,774,091; and 5,757,320, which are hereby incorporated herein by reference in their respective entireties.

A microprocessor may also be provided as part of the down-hole electronics. The microprocessor represents a circuit or device which is capable of coordinating the activities of the various down-hole electronic devices and instruments and may also provide for the processing of signals and data acquired at the boring tool. It is understood that the microprocessor may constitute or incorporate a microcontroller, a digital signal processor (DSP), analog signal processor or other type of data or signal processing device. Moreover, the microprocessor may be configured to perform rudimentary, moderately complex or highly sophisticated tasks depending on a given system configuration or application. By way of example, a more sophisticated system configuration may involve local signal processing of sensor data acquired by one or more of the accelerometers, magnetometers, GP-radar IC, and/or other geophysical and environmental sensors provided at the boring tool.

Another relatively sophisticated boring tool system deployment may involve the acquisition of various down-hole sensor data, production of control signals that control the boring operation, and comparison of a pre-planned bore plan loaded into memory accessed by the down-hole microprocessor with the actual bore path as indicated by the on-board down-hole sensors. The microprocessor may also incorporate or otherwise cooperate with a signal processing device to process GPR data acquired by the GP-radar IC and other data acquired by the geophysical/environmental sensors. The processed GPR and geophysical/environmental data may be transmitted to an aboveground display unit for evaluation by an operator.

In one embodiment, a portable tracker unit comprises a ground penetrating radar (GPR) unit. According to this embodiment, the boring tool includes a receiver and a signal processing device. The boring tool receiver receives a probe signal transmitted by the GPR unit, and the signal processing device generates a boring tool signal in response to the probe signal. The boring signal according to this embodiment has a characteristic that differs from the probe signal in one of timing, frequency content, information content, or polarization. Cooperation between the probe signal transmitter provided at the tracker unit and the signature signal generating device provided at the boring tool results in accurate detection of the boring tool location and, if desired, orientation, despite the presence of a large background signal. The GPR unit may also implement conventional subsurface imaging techniques for purposes of detecting the boring tool and buried obstacles. Various techniques for determining the position and/or orientation of a boring tool and for characterizing subsurface geology using a ground penetrating radar approach are disclosed in commonly assigned U.S. Pat. Nos. 5,720,354 and 5,904,210, both of which are hereby incorporated herein by reference in their respective entireties.

An exemplary approach for detecting an underground object and determining the range of the underground object involves the use of a transmitter, which is coupled to an antenna, that transmits a frequency-modulated probe signal at each of a number of center frequency intervals or steps. A receiver, which is coupled to the antenna when operating in a monostatic mode or, alternatively, to a separate antenna when operating in a bistatic mode, receives a return signal from a target object resulting from the probe signal. Magnitude and phase information corresponding to the object are measured and stored in a memory at each of the center frequency steps. The range to the object is determined using the magnitude and phase information stored in the memory. This swept-step radar technique provides for high-resolution probing and object detection in short-range applications, and is particularly useful for conducting high-resolution probing of geophysical surfaces and underground structures. A radar unit provided as part of an aboveground tracker unit or in-situ the boring tool may implement a swept-step detection methodology as described in U.S. Pat. No. 5,867,117, which is hereby incorporated herein by reference in its entirety.

A gas detector may also be incorporated on or within the boring tool housing and/or a backreamer which is coupled to the drill string subsequent to excavating a pilot bore. The gas detector may be used to detect the presence of various types of potentially hazardous gas sources, including methane and natural gas sources. Upon detecting such a gas, drilling may be halted to further evaluate the potential hazard. The location of the detected gas may be identified and stored to ensure that the potentially hazardous location is properly mapped and subsequently avoided.

The boring tool down-hole sensor unit may also include one or more temperature sensors which sense the ambient temperature within the boring tool housing and/or each of the down-hole sensors and associated circuits. Using several temperature sensors provides for the computation of an average ambient temperature and/or average sensor temperature. The temperature data acquired using the temperature sensors may be used to compensate for temperature related accuracy deviations that affect a given down-hole sensor. Detection of an appreciable change in temperature, such as an appreciable increase in boring tool temperature, for example, may result in an increase in the sampling/acquisition rate of data obtained from the various down-hole sensor data in order to better characterize and compensate for temperature related affects on the acquired data.

The data acquired by the various down-hole sensors, and, if applicable, the GPR unit and other geophysical sensors are transmitted to a controller at the boring machine, the controller interchangeably referred to herein as a central processor. The central processor may be implemented using a single processor or multiple processors at the boring machine. Alternatively, the central processor may be located remotely from the boring system, such as at a distantly located central processing location or multiple remote processing locations. In one embodiment, satellite, microwave or other form of high-speed telecommunication may be employed to effect the transmission of sensor data, control signals, and other information between a remotely situated central processor and the boring machine/boring tool components of a real-time boring control system.

The central processor processes the received boring tool telemetry/GPR/geophysical sensor data and data associated with boring machine activities during the drilling operation, such as data concerning pump pressures, motor speeds, pump/motor vibration, engine output, and the like. In certain embodiments, a real-time control methodology of the present invention provides for the elimination of the locator operator and, in another embodiment, may further provide a down-range operator of the boring system with status information and a total or partial control capability via a hand-held or otherwise mobile remote control facility.

Using the various sensor data, and preferably using data representative of a pre-planned bore path, the central processor computes any needed boring tool course changes and boring machine operational changes in real-time so as to maintain the boring tool on the pre-planned bore path and at an optimal level of boring tool productivity. The central processor may make gross and subtle adjustments to a boring operation based on various other types of acquired data, including, for example, geophysical data at the drilling site acquired prior to or during the boring operation, drill string/drill head/installation product data such as maximum bend radii and stress/strain data, and the location and/or type of buried obstacles (e.g., utilities) and geology detected during the boring operation, such as that obtained by use of a down-hole or aboveground GPR unit or geophysical sensor.

In the case of a detected buried obstacle or undesirable soil/rock condition (e.g., hard rock or soft rock), the central processor may effect "on-the-fly" deviations in the actual boring tool excavation course by recomputing a valid alternative bore plan. On-the-fly deviations in actual boring tool heading may also be effected directly by the operator. In response to such deviations, the central processor computes an alternative bore plan which preferably provides for safe bypassing of such an obstruction/soil condition while passing as close as possible through the targets established for the original pre-planned bore path. Any such course deviation is communicated visually and/or audibly to the operator and recorded as part of an "as-built" bore path data set. If an acceptable alternative bore plan cannot be computed due to operational or safety constraints (e.g., maximum drill string bend radius will be exceeded or clearance from detected buried utility is less than pre-established minimum clearance margin), the drilling operation is halted and a suitable warning message is communicated to the operator.

Boring productivity is further enhanced by controlling the delivery of fluid, such as a mud and water mixture or an air and foam mixture, to the boring tool during excavation. The central processor, typically in cooperation with a machine controller, controls various fluid delivery parameters, such as fluid volume delivered to the boring tool and fluid pressure and temperature for example. The central processor may also monitor and adjust the viscosity of the fluid delivered to the boring tool, as well as the composition of the fluid. For example, the central processor may modify fluid composition by controlling the type and amount of solid or slurry material that is added to the fluid. The composition of the fluid delivered to the boring tool may be selected based on the composition of soil/rock subjected to drilling and appropriately modified in response to encountering varying soil/rock types at a given boring site. Additionally, the composition of the fluid may be selected based upon the drill string rotation torque or thrust/pullback force.

The central processor may further enhance boring productivity by controlling the configuration of the boring tool according to soil/rock type and boring tool steering/productivity requirements. One or more actuatable elements of the boring tool, such as controllable plates, duckbill, cutting bits, fluid jets, and other earth engaging/penetrating portions of the boring tool, may be controlled to enhance the steering and cutting characteristics of the boring tool. In an embodiment that employs an articulated drill head, the central processor may modify the head position, such as by communicating control signals to a stepper motor that effects head rotation, and/or speed of the cutting heads to enhance the steering and cutting characteristics of the articulated drill head. The pressure and volume of fluid supplied to a fluid hammer type boring tool, which is particularly useful when drilling through rock, may be modified by the central processor. The central processor ensures that modifications made to alter the steering and cutting characteristics of the boring tool do not result in compromising drill string, boring tool, installation product, or boring machine performance limitations.

An adaptive steering mode of operation provides for the active monitoring of the steerability of the boring tool within the soil/rock subjected to drilling. The steerability factor indicates how quickly the drill head can effect steering changes in a particular soil/rock composition, and may be expressed in terms of rate of change of pitch or yaw as the drill head moves longitudinally. If, for example, the soil/rock steerability factor indicates that the actual drill string curvature will be flatter than the planned curvature, the central processor may alter the pre-planned bore path so that the more desirable bore path is followed while ensuring that critical underground targets are drilled to by the drill head. The steerability factor may be dynamically determined and evaluated during a boring operation.

Historical and current steerability factor data may thus be acquired during a given drilling operation and used to determine whether or not a given bore path should be modified. A new bore path may be computed if desired or required using the historical and current steerability factor data. The adaptive steering mode may also consider factors such as utility/obstacle location, desirable safety clearance around utilities and obstacles, allowable drill string and product bend radius, and minimum ground cover and maximum allowable depth when altering the pre-planned bore path.

Another embodiment of the present invention provides an operator with the ability to control all or a sub-set of boring system functions using a remote control facility. According to this embodiment, an operator initiates boring machine and boring tool commands using a portable control unit. Boring machine/tool status information is acquired and displayed on a graphics display provided on the portable control unit. The portable control unit may also embody the drill head locating receiver and/or the radio that transmits data to the boring machine receiver/display. As will be discussed in greater detail, varying degrees of functionality may be built into the portable control unit, boring tool electronics package, and boring machine controllers to provide varying degrees of control by each of these components.

By way of example, one system embodiment employs a conventional sonde-type transmitter in the boring tool and a remote control unit that employs a traditional methodology for locating the boring tool. A Global Positioning System (GPS) unit or laser unit may also be incorporated into the remote control unit to provide a comparison between actual and predetermined boring tool/operator locations. Using the location information acquired using conventional locator techniques, an operator may use the remote control unit to transmit control and steering signals to the boring machine to effect desired alterations to boring tool productivity and steering. By way of further example, the boring tool may be equipped with a relatively sophisticated down-hole sensor unit and a local control and data processing capability. According to this system configuration, the remote control unit transmits control and/or steering signals to the boring tool, rather than to the boring machine, to control drilling productivity and direction.

The down-hole sensor unit at the boring tool may produce various control signals in response to the data and the signals received from the remote control unit. The control signals are transmitted to the boring machine to effect the necessary changes to boring machine/boring tool operations. It will be appreciated that, using the various hardware, software, sensor, and machine components described herein, a large number of boring machine system configurations may be implemented. The degree of sophistication and functionality built into each system component may be tailored to meet a wide variety of excavation and geologic surveying needs.

Referring now to FIG. 1, FIG. 1 illustrates a cross-section through a portion of ground 10 where a boring operation takes place. The underground boring system, generally shown as the machine 12, is situated aboveground 11 and includes a platform 14 on which is situated a tilted longitudinal member 16. The platform 14 is secured to the ground by pins 18 or other restraining members in order to prevent the platform 14 from moving during the boring operation. Located on the longitudinal member 16 is a thrust/pullback pump 17 for driving a drill string 22 in a forward, longitudinal direction as generally shown by the arrow. The drill string 22 is made up of a number of drill string members 23 attached end-to-end. Also located on the tilted longitudinal member 16, and mounted to permit movement along the longitudinal member 16, is a rotation motor or pump 19 for rotating the drill string 22 (illustrated in an intermediate position between an upper position 19*a* and a lower position 19*b*). In operation, the rotation motor 19 rotates the drill string 22 which has a boring tool 24 attached at the end of the drill string 22.

A typical boring operation takes place as follows. The rotation motor 19 is initially positioned in an upper location 19*a* and rotates the drill string 22. While the boring tool 24 is rotated, the rotation motor 19 and drill string 22 are pushed in a forward direction by the thrust/pullback pump 17 toward a lower position into the ground, thus creating a borehole 26. The rotation motor 19 reaches a lower position 19*b* when the drill string 22 has been pushed into the borehole 26 by the length of one drill string member 23. A new drill string member 23 is then added to the drill string 22 either manually or automatically, and the rotation motor 19 is released and pulled back to the upper location 19*a*. The rotation motor 19 is used to thread the new drill string member 23 to the drill string 22, and the rotation/push process is repeated so as to force the newly lengthened drill string 22 further into the ground, thereby extending the borehole 26. Commonly, water or other fluid is pumped through the drill string 22 by use of a mud or water pump. If an air hammer is used, an air compressor is used to force air/foam through the drill string 22. The water/mud or air/foam flows back up through the borehole 26 to remove cuttings, dirt, and other debris. A directional steering capability is typically provided for controlling the direction of the boring tool 24, such that a desired direction can be imparted to the resulting borehole 26.

In accordance with one embodiment, a down-hole sensor unit of the boring tool 24 is communicatively coupled to the central processor 25 of the boring machine 12 through use of a communication link established via the drill string 22. The communication link may be a coaxial cable, an optical fiber or some other suitable data transfer medium extending within and along the length of the drill string 22. The communication link may alternatively be established using a free-space link for infrared or microwave communication or an acoustic telemetry approach external to the drill string 22. Communication of information between the boring tool 24 and the central processor 25 may also be facilitated using a mud pulse technique as is known in the art.

Figure 18:
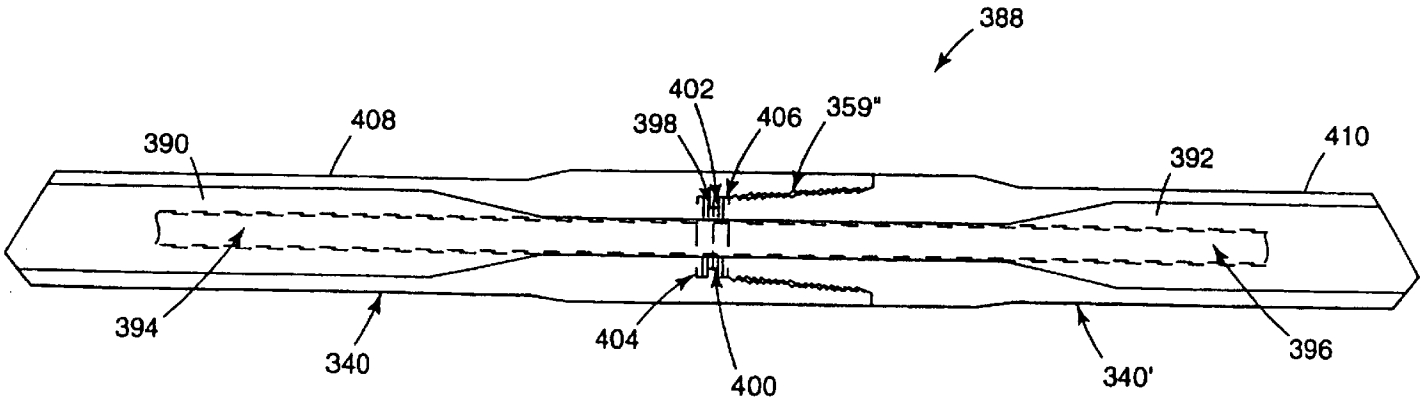
FIG. 18 is a longitudinal cross-sectional view of portions of two drill stems that mechanically couple to establish a communication link therebetween according to an embodiment of the present invention.

According to another embodiment, the communication link established between the boring tool and the central processor via the drill string comprises an electrical conductor integral with each connected drill stem of the drill string. FIG. 18 shows generally at 388 a longitudinal cross sectional view of portions of drill stems 340 and 340' mechanically coupled at mechanical coupling point 359". Drill stems 340 and 340' include outer surfaces 408 and 410, respectively, and inner surfaces defining hollow passages 390 and 392, respectively. The first drill stem 340 includes a segment of electrical conductor 394 that is encapsulated in an electrically insulative material. Likewise, the second drill stem 340' also includes a segment of electrical conductor 396 that is encapsulated in an electrically insulative material. The first drill stem 340 includes a conductive ring 398 disposed at one end. Adjacent to the conductive ring 398, the first drill stem 340 also includes an insulative (non-electrically-conductive) ring 404. The second drill stem 340' also includes a conductive ring 400, and an insulative ring 406 disposed adjacently to the conductive ring 400.

When the second drill stem 340' is mechanically coupled to the first drill stem 340 at mechanical coupling point 359", an electrical contact point 402 is formed between the conductive rings 398 and 400. As the second drill stem 340' is coupled to the first drill stem 340, the conductive ring 398 forms an electrical contact with the electrical conductor segment 394 disposed within the hollow passage 390. Likewise, the conductive ring 400 forms an electrical contact with the electrical conductor segment 396. Accordingly, a continuous electrical connection is formed between the newly added second drill stem 340' through the electrically conductive coupling point 402 and mechanical coupling point 359" to the portion of the drill string 328 formed by the drill stem 340, the starter rod (not shown) and the drill head (not shown).

The electrically insulative rings 404 and 406 electrically isolate the conductive rings 398 and 400, respectively, from the outer surfaces 408 and 410, respectively, of the drill stems 340, 340', respectively. The electrically insulative material encapsulating the electrical conductors 394, 396 electrically isolate the electrical conductor segments 394, 396 from the outer surfaces 408, 410, respectively. Additional embodiments directed to the use of integral electrical drill stem elements for effecting communication of data between a boring tool and boring machine are disclosed in co-owned U.S. application Ser. No. 09/405,541, entitled "Apparatus and Method for Providing Electrical Transmission of Power and Signals in a Directional Drilling Apparatus," filed on Sep. 24, 1999 and identified as Attorney Docket No. 10646.247-US-01, which is hereby incorporated herein by reference in its entirety.

In accordance with another embodiment or the present invention, and with reference once again to FIG. 1, a tracker unit 28 may be employed to receive an information signal transmitted from boring tool 24 which, in turn, communicates the information signal or a modified form of the signal to a receiver situated at the boring machine 12. The boring machine 12 may also include a transmitter or transceiver for purposes of transmitting an information signal, such as an instruction signal, from the boring machine 12 to the tracker unit 28. In response to the received information signal, the tracker unit 28 may perform a desired function, such as transmitting data or instructions to the boring tool 24 for purposes of uplinking diagnostic or sensor data from the boring tool 24 or for adjusting a controllable feature of the boring tool 24 (e.g., fluid jet orifice configuration/spray direction or cutting bit configuration/orientation). It is understood that transmission of such data and instructions may alternatively be facilitated through use of a communication link established between the boring tool 24 and central processor 25 via the drill string 22.

According to another embodiment, the tracker unit 28 may instead take the form of a signal source for purposes of transmitting a target signal. The tracker unit 28 may be positioned at a desired location to which the boring tool is intended to pass or reach. The boring tool may pass below the tracker unit 28 or break through the earth's surface proximate the tracker unit 28. The tracker unit 28 may emit an electromagnetic signal which may be sensed by an appropriate sensor provided within or proximate the boring tool 24, such as a magnetometer for example. The central processor cooperates with the target signal sensor of the boring tool 24 to guide the boring tool 24 toward the tracker unit 28.

In one configuration, the tracker unit 28 may be incorporated in a portable unit which may be carried or readily moved by an operator. The operator may establish a target location by moving the portable tracker unit 28 to a desired aboveground location. The central processor, in response to sense signals received from the boring tool 24, controls the boring machine so as to guide the boring tool 24 in the direction of the target signal source. Alternatively, steering direction information can be provided to an operator at the boring machine or remote from the boring machine by way of the central processor or remote unit to allow the operator to make steering/control decisions.

Figure 2:
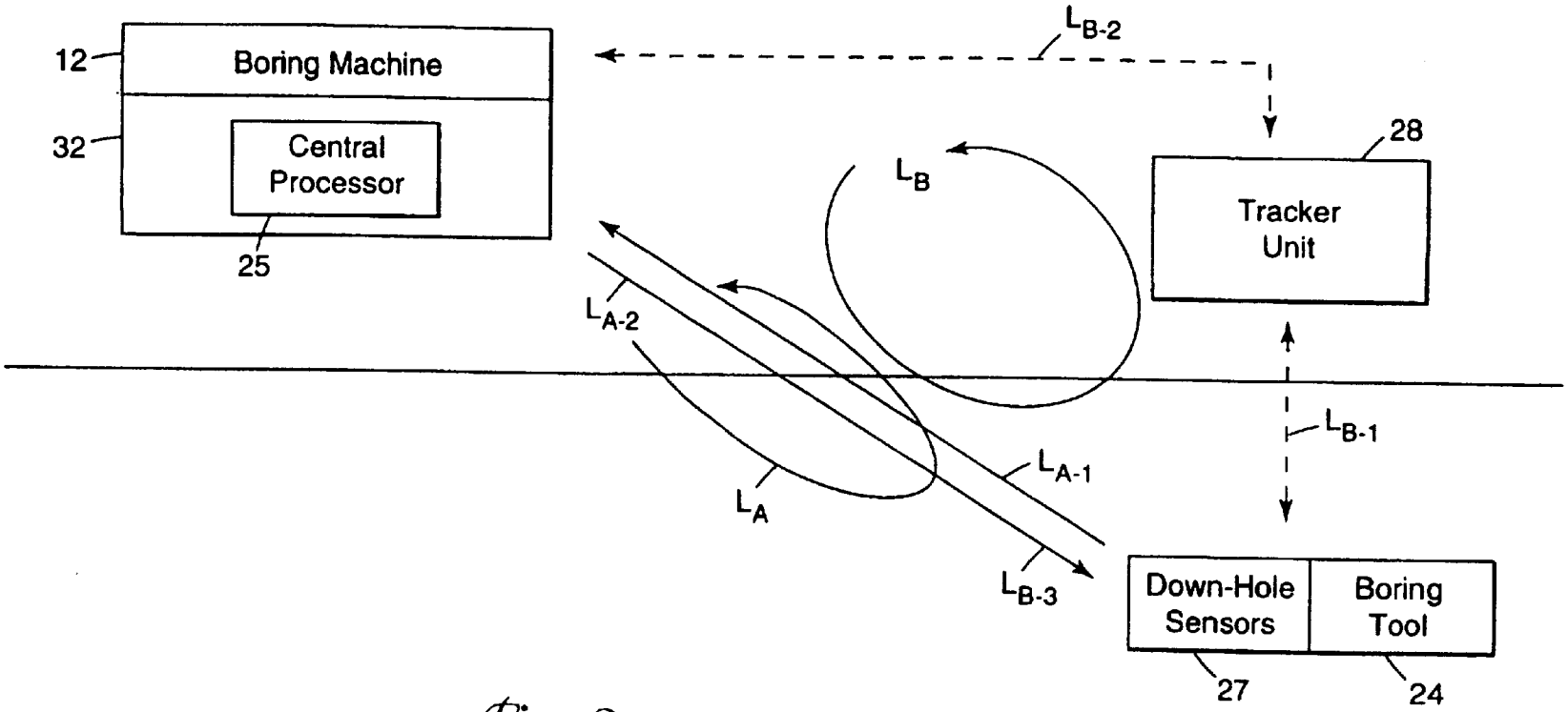
FIG. 2 depicts a closed-loop control system comprising a first control loop and an optional second control loop as defined between a boring machine and a boring tool according to the principles of the present invention.

FIG. 2 illustrates an important aspect of the present invention. In particular, FIG. 2 110 depicts various embodiments of a closed-loop control system as defined between the boring machine 12 and the boring tool 24. According to one embodiment, communication of information between the boring machine 12 and the boring tool 24 is facilitated via the drill string. A control loop, $L_A$, illustrates the general flow of information through a closed-loop boring control system according to a first embodiment of the present invention. The down-hole sensor unit 27 provided in the boring tool 24 provides location and orientation data. The acquired data may be processed locally within the down-hole sensor unit 27. The data acquired at the boring tool 24 is transmitted as an information signal along a first loop segment, $L_{A-1}$, and is received by the boring machine 12. The received information signal is processed by the central processor 25 typically provided in a control unit 32 of the boring machine 12. Control signals that modify the direction and productivity of the boring tool 24 may produced by at the boring machine 12 or by the down-hole sensor unit 27.

In response to the processed information signal, desired adjustments are made by the boring machine 12 to alter or maintain the activity of the boring tool 24, such adjustments being effected along a second loop segment, $L_{A-2}$, of the control loop, $L_A$. It is noted that the first loop segment, $L_{A-1}$, typically involves the communication of electrical, electromagnetic, optical, acoustic or mud pulse signals, while the second loop segment, $L_{A-2}$, typically involves the communication of mechanical/hydraulic forces. It is noted that the second loop segment, $L_{A-2}$, may also involve the communication of electrical, electromagnetic or optical signals to facilitate communication of data and/or instructions from the central processor 25 to the navigation package 27 of the boring tool 24.

In accordance with a second embodiment, a closed-loop control system is defined between the boring machine 12, boring tool 24, and tracker unit 28. A control loop, $L_B$, illustrates the general flow of information through this embodiment of a closed-loop control system of the present invention. The boring tool 24 transmits an information signal along a first loop segment, $L_{B-1}$, which is received by the tracker unit 28. In response to the received information signal, the tracker unit 28 transmits an information signal along a second loop segment, $L_{B-2}$, which is received by the central processor 25. The received information signal is processed by the central processor 25 of the boring machine 12. In response to the processed information signal, desired adjustments are made by the boring machine 12 to alter or maintain the activity of the boring tool 24, such adjustments being effected along a third loop segment, $L_{B-3}$, of the control loop, $L_B$. It is noted that the first and second loop segments, $L_{B-1}$ and $L_{B-2}$, typically involve the communication of electrical, electromagnetic, optical, or acoustic signals, while the third loop segment, $L_{B-3}$, typically involves the communication of mechanical/hydraulic forces. It is further noted that the third loop segment, $L_{B-3}$, may also involve the communication of electrical, electromagnetic or optical signals to facilitate communication of data and/or instructions from the central processor 25 to the navigation package 27 of the boring tool 24.

Figure 15A:
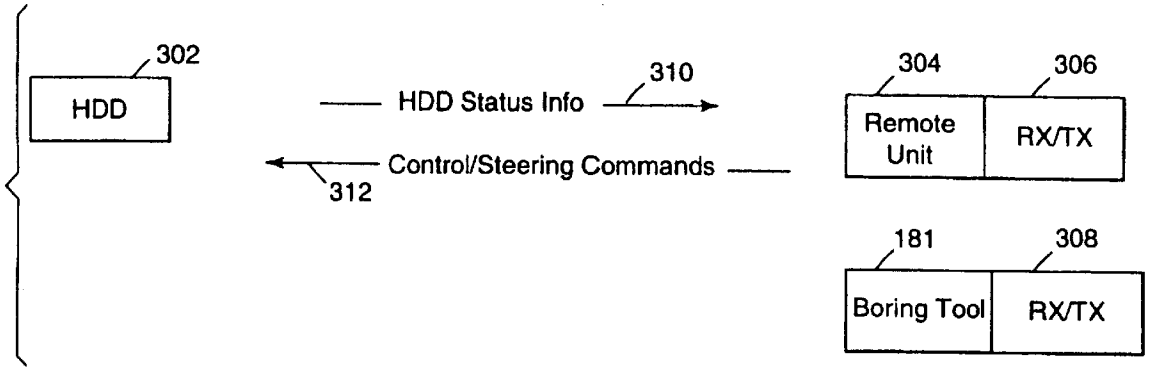
FIG. 15A illustrates a boring system configuration which includes a portable remote unit for controlling boring machine activities from a site remote from the boring machine in accordance with an embodiment of the present invention.
Figure 15B:
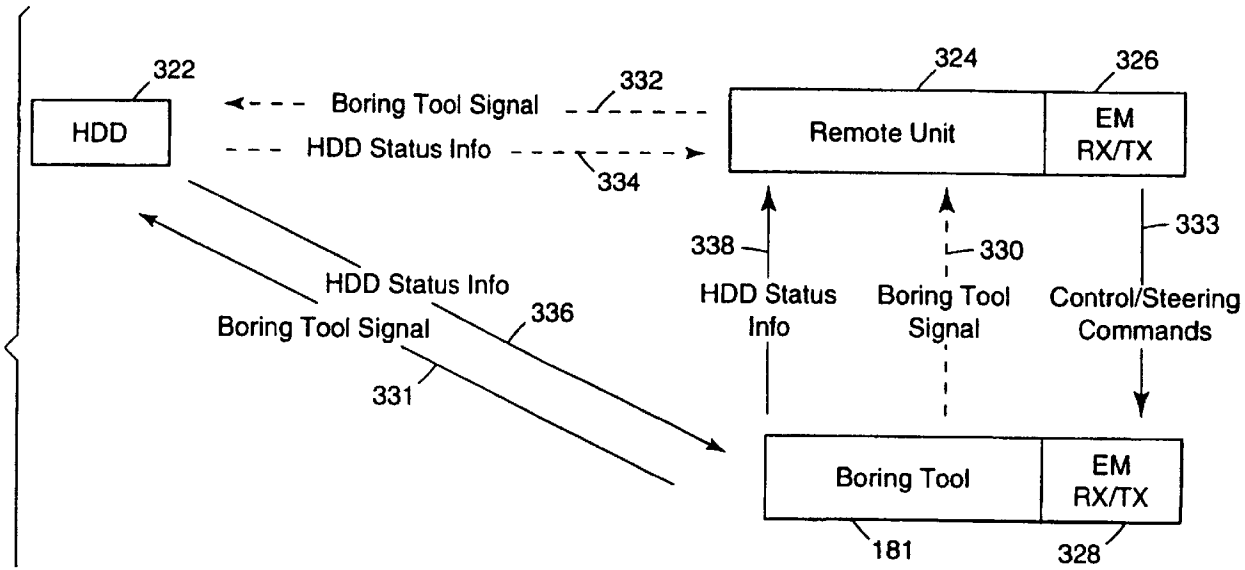
FIG. 15B illustrates a boring system configuration which includes a portable remote unit for controlling boring machine activities from a site remote from the boring machine in accordance with another embodiment of the present invention.

According to another embodiment, the control loop, $L_B$, may provide for the initiation of control/steering signals at the tracker unit 28 which may be received by either the boring machine 12 or the navigation electronics 27 of the boring tool 24. It will be appreciated that the components of the boring control system, the generation and processing of various control, steering, and target signals, and the flow of information through the components may be selected and modified to address a variety of system and application requirements. As such, it will be understood that the control loops depicted in FIG. 2 and other figures are provided for illustrating particular closed-loop control methodologies, and are not to be regarded as limiting embodiments. FIGS. 15A and 15B, for example, illustrate other configurations of closed-loop control system paths through the various system components, as will be discussed in greater detail hereinbelow.

A control system and methodology according to the principles of the present invention provides for the acquisition and processing of boring tool location, orientation, and physical environment information (e.g., temperature, stress/pressure, operating status), which may include geophysical data, in real-time. Real-time acquisition and processing of such information by the central processor 25 provides for real-time control of the boring tool 24 and the boring machine 12. By way of example, a near-instantaneous alteration or halting of boring tool progress may be effected by the central processor 25 via the closed-loop control loops $L_A$ or $L_B$ depicted in FIG. 2 or other control loop upon detection of an unknown obstruction without experiencing delays associated with human observation and decision making.

It is believed that the latency associated with the acquisition and processing of boring tool signal information of a control loop defined between the boring machine 12 and the boring tool 24 is on the order of milliseconds. In certain applications, this latency may be in excess of a second, but is typically less than two to three seconds. Such extended latencies maybe reduced by using faster data communication and processing hardware, protocols, and software. In certain system configurations which utilize above-ground receiver/transmitter units, the use of repeaters may significantly reduce delays associated with acquiring and processing information concerning the position and activity of the boring tool 24. Repeaters may also be employed along a communication link established through the drill stem.

In addition to the above characterization of the term "real-time" which is expressed within a quantitative context, the term "real-time," as it applies to a closed-loop boring control system, may also be characterized as the maximum duration of time needed to safely effect a desired change to a particular boring machine or boring tool operation given the dynamics of a given application, such as boring tool displacement rate, rotation rate, and heading, for example. By way of example, steering a boring tool which is moving at a relatively high rate of displacement so as to avoid an underground hazard requires a faster control system response time in comparison to steering the boring tool to avoid the same hazard at a relatively low rate of displacement. A latency of two, three or four seconds, for example, may be acceptable in the low displacement rate scenario, but would likely be unacceptable in the high displacement rate scenario.

In the context of the control loop configurations depicted in FIG. 2, it is believed that the delay associated with the acquisition and processing of boring tool signal information communicated along loop segment $L_{A-1}$ of loop $L_A$ or along loop segments $L_{B-1}$ and $L_{B-2}$ of loop $L_B$ and subsequent production of appropriate boring machine/tool control signals by the central processor 25 of the boring machine 12 is on the order of milliseconds and, depending on a given system deployment, may be on the order of microsec0onds. It can be appreciated that the responsiveness of the boring tool 24 to the produced boring machine control signals (i.e., loop segments $L_{A-2}$ or $L_{B-3}$) is largely dependent on the type of boring machine and tool employed, soil/rock conditions, mud/water/foam/air flow rate and pressure, length of drill string, and operational characteristics of the various pumps and other mechanisms involved in the controlled rotation and displacement of the boring tool 24, all of which may be regarded as cumulative mechanical latency. Although such cumulative mechanical latency will generally vary significantly, the mechanical latency for a typical drilling system configuration and drill stem length is typically on the order of a few seconds, such as about two to four seconds.

With reference to FIGS. 3A–3E, five different control system methodologies for controlling a boring operation according to the present invention are illustrated. Concerning the embodiment depicted in FIG. 3A, the entry location of the boring tool into the subsurface relative to a reference is determined 550, such as by use of GPS or GRS techniques. The boring tool is thrust into the ground by the addition of several drill rods to the boring tool/drill string. The boring tool is pushed away from the boring machine by a distance sufficient to prevent magnetic fields produced by the boring machine from perturbing the earth's magnetic field proximate the boring tool or from interfering with the magnetic field sensors provided in the boring tool. The boring tool heading is then stabilized and initialized 552, such as by use of a walkover device.

Sensor data is acquired from the down-hole sensors of the boring tool. Any applicable up-hole sensor data, if available, is also acquired 556. Such up-hole sensor data may include, for example, drill rod displacement data. Sensor data representative of the environmental status at the boring tool (e.g., pressure, temperature, etc.) and geophysical sensor data concerning the geology at the excavation site, such as underground structures, obstructions, and changes in geology, may also be acquired 558. Data concerning the operation of the boring machine is also acquired 560. The position of the boring tool is then computed 562 based on boring tool heading data and the drill rod displacement data.

Figure 3A:
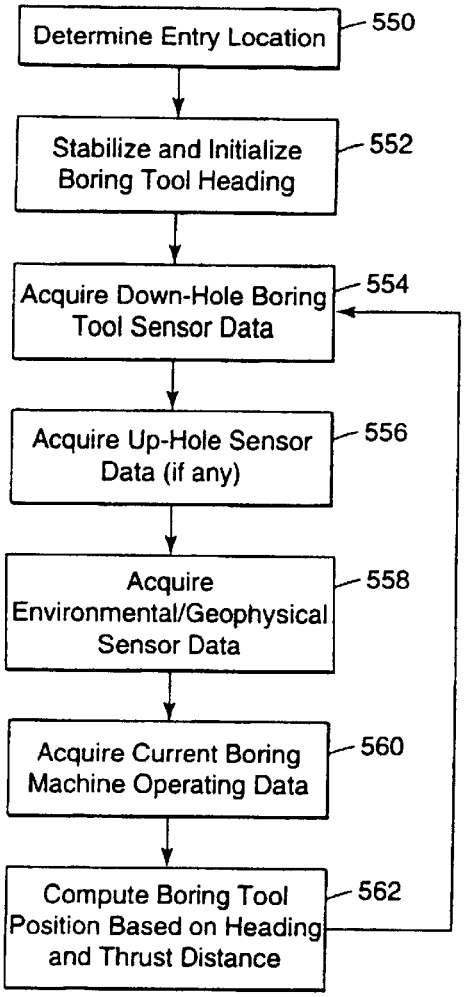
FIGS. 3A–3E depict various process steps associated with a number of different embodiments of a real-time closed-loop control system of the present invention.
Figure 3B:
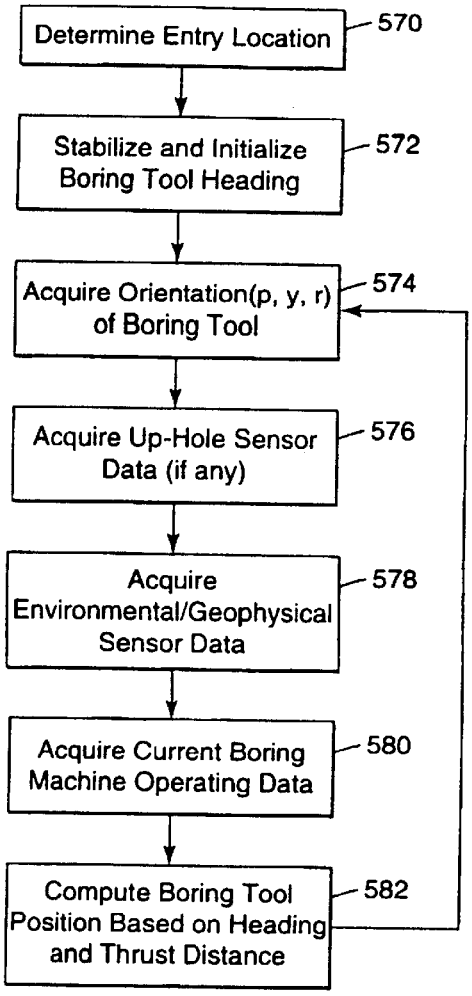

Concerning the embodiment of FIG. 3B, the entry location is determined 570 and the boring tool heading is stabilized and initialized 572. According to this embodiment, boring tool orientation data, such as pitch, yaw, and roll, is acquired 574 from the down-hole sensors. Any applicable up-hole sensor data is acquired 576, as is any available environmental and geophysical sensor data 578. Data concerning the operation of the boring machine is also acquired 580. The position of the boring tool is then computed 582 based on boring tool heading data and the drill rod displacement data.

Figure 3C:
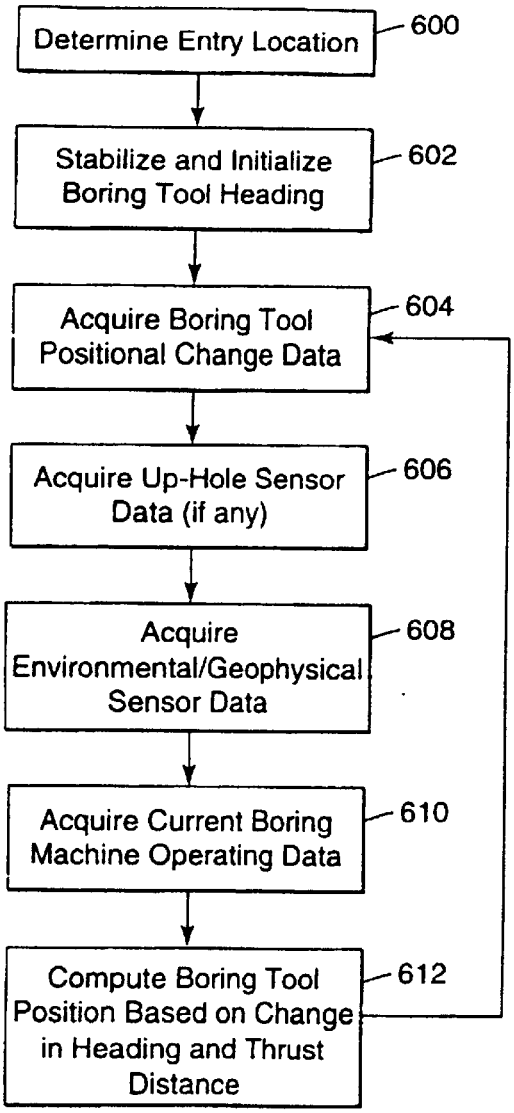

With regard to the embodiment of FIG. 3C, the entry location is determined 600 and the boring tool heading is stabilized and initialized 602. Data representative of a change in the orientation or position of the boring tool is acquired 604 according to this embodiment. For example, the down-hole sensors may a change in boring tool orientation in terms of pitch, yaw, and roll. The orientation change data may be transmitted for aboveground processing.

Applicable up-hole sensor data 606, environmental/geophysical sensor data 608, and boring machine operating data 610 may also be acquired. The position of the boring tool is then computed 612 based on the change of boring tool heading data and the drill rod displacement data.

Figure 3D:
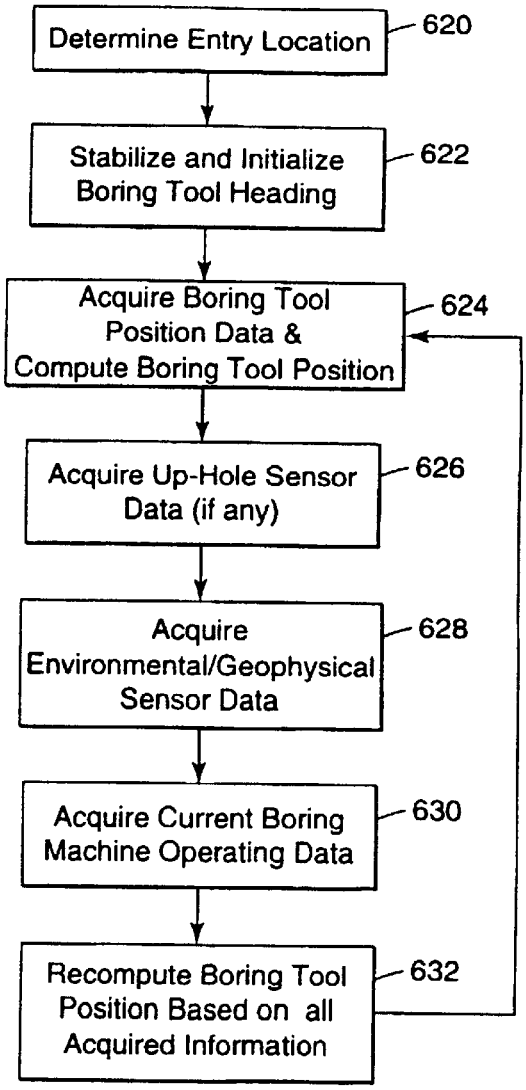

Concerning the embodiment of FIG. 3D, the entry location is determined 620 and the boring tool heading is stabilized and initialized 622. According to this embodiment, data representative of the position of the boring tool is acquired 624, and the position of the boring tool is computed down-hole at the boring tool and transmitted for aboveground processing. Applicable up-hole sensor data 626, environmental/geophysical sensor data 628, and boring machine operating data 630 may also be acquired. The boring tool position computed down-hole may be improved on aboveground by recomputing 632 the boring tool position based on all relevant acquired data, such as drill rod displacement data.

Figure 3E:
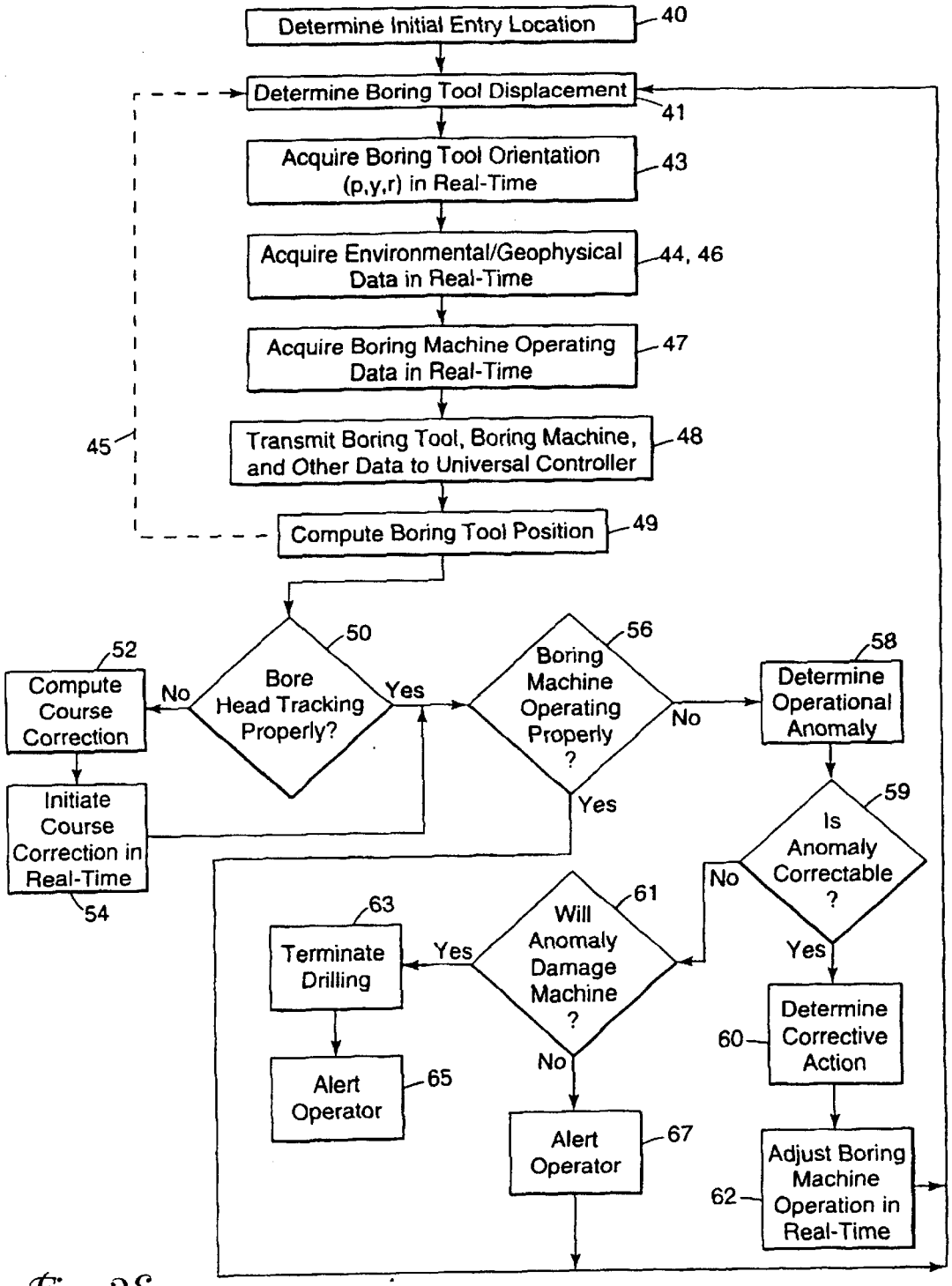

FIG. 3E illustrates an embodiment of a boring control system methodology for controlling boring machine and boring tool activities in accordance with a successive approximation approach. Concerning the embodiment of FIG. 3E, and with continued reference to FIG. 2, the starting location of the bore, such as the bore entry point, is determined 40 with respect to a predetermined reference, such as by use of a GPS or Geographic Reference System (GRS) facility. The displacement of the boring tool 24 is computed and acquired 41 in real-time by use of a known technique, such as by monitoring the number of drill rods of known length added to the drill string during the boring operation or by monitoring the cumulative length of drilling pipe which is thrust into the ground.

Boring tool sensor data is acquired during the boring operation in real-time from various sensors provided in the down-hole sensor unit 27 at the boring tool 24. Such sensors typically include a triad or three-axis accelerometer, a three-axis magnetometer, and a number of environmental and geophysical sensors. The acquired data is communicated to the central processor 25 via the drill string communication link or via the tracker unit 28.

Data concerning the orientation of the boring tool 24 is acquired 43 in real-time using the sensors of the down-hole sensor unit 27 and/or through cooperative use of the tracker unit 28.

The orientation data typically includes the pitch, yaw, and roll (i.e., p, y, r) of the boring tool, although roll data may not be required. Depending on a given application, it may also be desirable or required to acquire 44 environmental data concerning the boring tool 24 in real-time, such as boring tool temperature and stress/pressure, for example. Geophysical and/or geological data may also be acquired 46 in real-time. Data concerning the operation of the boring machine 12 is also acquired 47 in real-time, such as pump/motor/engine productivity or pressure, temperature, stress (e.g., vibration), torque, speed, etc., data concerning mud/air/foam flow, composition, and delivery, and other information associated with operation of the boring system 12.

The boring tool data, boring machine data, and other acquired data is communicated 48 to the central processor 25 of the boring machine 12. The central processor 25 computes 49 the location of the boring tool 24, preferably in terms of x-, y-, and z-plane coordinates. The location computation is preferably based on the orientation of the boring tool 24 and the change in boring tool position relative to the initial entry point or any other selected reference point. The boring tool location is typically computed using the acquired boring tool orientation data and the acquired boring tool/drill string displacement data. Acquiring boring tool and machine data, transmitting this data to the central processor 25, and computing the current boring tool position preferably occurs on a continuous or periodic real-time basis, as is indicated by the dashed line 45.

The process of computing a current location of the boring tool, displacing the boring tool, sensing a change in boring tool position, and recomputing the current location of the boring tool on an incremental basis (e.g., successive approximation navigation approach) is repeated during the boring operation. A successive approximation navigation approach within the context of the present invention advantageously obviates the need to temporarily halt boring tool movement when performing a current boring tool location computation, as is require using conventional techniques. A walkover tracker or locator may, however, be used in cooperation with the magnetometers of the boring tool to confirm the accuracy of the trajectory of the boring tool and/or bore path.

The computed location of the boring tool 24 is typically compared against a pre-planned boring route to determine 50 whether the boring tool 24 is progressing along the desired underground path. If the boring tool 24 is deviating from the desired pre-planned boring route, the central processor 25 computes 52 an appropriate course correction and produces control signals to initiate 54 the course correction in real-time. In one particular embodiment, the navigation electronics of the boring tool 24 computes the course correction and produces control signals which are transmitted to the boring machine 12 to initiate 54 the boring tool course correction.

If the central processor 25 determines 56 that the boring machine 12 is not operating properly or within specified performance margins, the central processor 25 attempts to determine 58 the source of the operational anomaly, determines 59 whether or not the anomaly is correctable, and further determines 61 whether or not the anomaly will damage the boring machine 12, boring tool 24 or other component of the boring system. For example, the central processor 25 may determine that the rotation pump is operating beyond a preestablished pressure threshold. The central processor 25 determines a resolution to the anomalous operating condition, such as by producing a control signal to reduce the thrust/pullback pump pressure so as to reduce rotation pump pressure without a loss in boring tool rotational speed.

If the central processor 25 determines 59 that the operational anomaly is not correctable and will likely cause damage to a component of the boring system, the central processor 25 terminates 63 drilling activities and alerts 65 the operator accordingly. If an uncorrectable anomalous condition will likely not cause damage to a boring system component, drilling activities continue and the central processor 25 alerts 67 the operator as to the existence of the problem. If the central processor 25 determines that the operational anomaly is correctable, the central processor 25 determines the corrective action 60 and adjusts 62 boring machine operations in real-time to correct the operational anomaly. The processes depicted in FIG. 3E are repeated on a continuous or periodic basis to facilitate real-time control of the boring tool 24 and boring system 12 during a boring operation.

Figure 4:
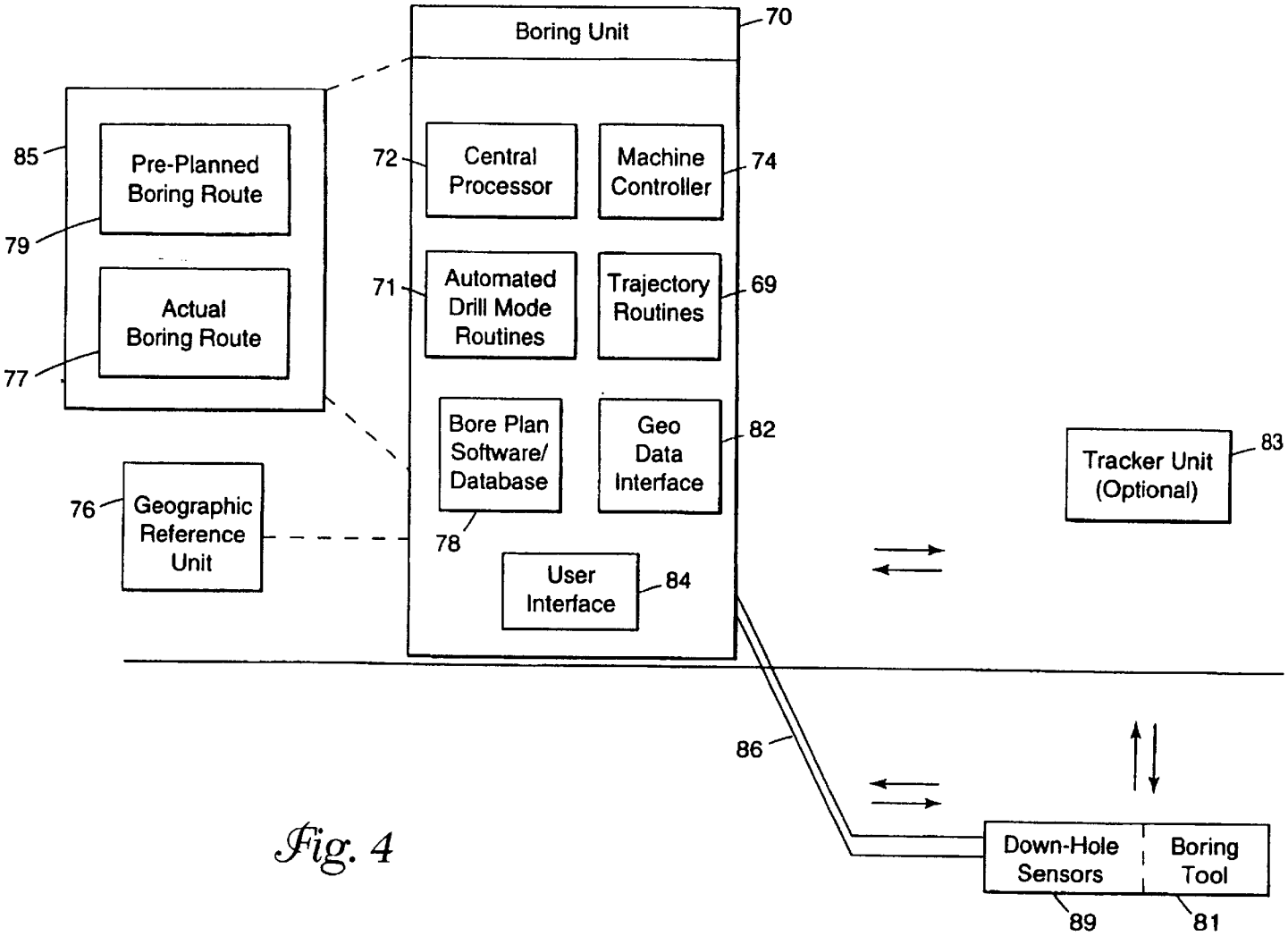
FIG. 4 is a block diagram of various components of a boring system that provide for real-time control of a boring operation in accordance with an embodiment of the present invention.

Referring to FIG. 4, there is illustrated a block diagram of various components of a boring system that provide for real-time control of a boring tool in accordance with an embodiment of the present invention. In accordance with the embodiment depicted in FIG. 4, a boring machine 70 includes a central processor 72 which interacts with a number of other controls, sensors, and data storing/processing resources. The central processor 72 processes boring tool location and orientation data communicated from the boring tool 81 via the drill string 86 or, alternatively, via the tracker unit 83 to a transceiver (not shown) of the boring machine 70. The central processor 72 may also receive geographic and/or topographical data from an external geographic reference unit 76, which may include a GPS-type system (Global Positioning System), Geographic Reference System (GRS), ground-based range radar system, laser-based positioning system, ultrasonic positioning system, or surveying system for establishing an absolute geographic position of the boring machine 70 and boring tool 81.

A machine controller 74 coordinates the operation of various pumps, motors, and other mechanisms associated with rotating and displacing the boring tool 81 during a boring operation. The machine controller 74 also coordinates the delivery of mud/foam/air to the boring tool 81 and modifications made to the mud/foam/air composition to enhance boring tool productivity. The central processor 72 typically has access to a number of automated drill mode routines 71 and trajectory routines 69 which may be executed as needed or desired. A bore plan database 78 stores data concerning a pre-planned boring route, including the distance and variations of the intended bore path, boring targets, known obstacles, unknown obstacles detected during the boring operation, known/estimated soil/rock condition parameters, and boring machine information such as allowable drill string or product bend radius, among other data.

The central processor 72 or an external computer may execute bore planning software 78 that provides the capability to design and modify a bore plan on-site. The on-site designed bore plan may then be uploaded to the bore plan database 78 for subsequent use. As will be discussed in greater detail hereinbelow, the central processor 72 may execute bore planning software and interact with the bore plan database 78 during a boring operation to perform "on the-fly" real-time bore plan adjustment computations in response to detection of underground hazards, undesirable geology, and operator initiated deviations from a planned bore program.

A geophysical data interface 82 receives data from a variety of geophysical and/or geologic sensors and instruments that may be deployed at the work site and at the boring tool. The acquired geophysical/geologic data is processed by the central processor 72 to characterize various soil/rock conditions, such as hardness, porosity, water content, soil/rock type, soil/rock variations, and the like. The processed geophysical/geologic data may be used by the central processor 72 to modify the control of boring tool activity and steering. For example, the processed geophysical/geologic data may indicate the presence of very hard soil/rock, such as granite, or very soft soil, such as sand. The machine controller 74 may, for example, use this information to appropriately alter the manner in which the thrust/pullback and rotation pumps are operated so as to optimize boring tool productivity for a given soil/rock type.

By way of further example, the central processor 72 may monitor the actual bend radius of a drill string 86 during a boring operation and compare the actual drill string bend radius to a maximum allowable bend radius specified for the particular drill string 86 in use or the product being installed. The machine controller 74 may alter boring machine operation and, in addition or in the alternative, the central processor 72 may compute an alternative bore path to ensure compliance with the maximum allowable bend radius requirements of the drill string in use or the product being installed. It is noted that pitch and yaw are vectors, and that actual drill string bend radius is a function of the vector sum of the change in pitch and yaw over a thrust distance. Boring machine alterations made to address a drill string/product overstressing condition should compute such alterations based on the magnitude and direction of the pitch and yaw vector sum over a given distance of thrust.

The central processor 72 may monitor the actual drill string/product bend radius to compare to the pre-planned path and steering plan, and adapt future control signals to accommodate any limitations in the steerability of the soil/rock strata. Additionally, the central processor 72 may monitor the actual bend radius, steerability factor, geophysical data, and other data to predict the amount of bore path straightening that will occur during the backreaming operation. Predicted bore path straightening, backreamer diameter, bore path length, type/weight of product being installed, and desired utility/obstacle safety clearance will be used to make alterations to the pre-planned bore path. This information will also be used when planning a bore path on-thy-fly, in order to reduce the risk of striking utilities/obstacles while backreaming.

The central processor 72 may also receive and process data transmitted from one or more boring tool sensors. Orientation, pressure, and temperature information, for example, may be sensed by appropriate sensors provided in the boring tool 81, such as a strain gauge for sensing pressure. Such information may be encoded on the signal transmitted from the boring tool 81, such as by modulating the boring tool signal with an information signal, or transmitted as an information signal separate from the boring tool signal. When received by the central processor 72, an encoded boring tool signal is decoded to extract the information signal content from the boring tool signal content. The central processor 72 may modify boring system operations if such is desired or required in response to the sensor information.

It is to be understood that the central processor 72 depicted in FIG. 4 and the other figures may, but need not, be implemented as a single processor, computer or device. The functions performed by the central processor 72 may be performed by multiple or distributed processors, and/or any number of circuits or other electronic devices. As was discussed previously, all or some of the functions associated with the central processor may be performed from a remotely located processing facility, such as a remote facility which controls the boring machine operations via a satellite or other high-speed communications link. By way of further example, the functionality associated with some or all of the machine controller 74, automated drill mode routines 71, trajectory routines 69, bore plan software/database 78, geophysical data interface 82, user interface 84, and display 85 may be incorporated as part of the central processor 72.

With continued reference to FIG. 4, a user interface 84 provides for interaction between an operator and the boring machine 70. The user interface 84 includes various manually-operable controls, gauges, readouts, and displays to effect communication of information and instructions between the operator and the boring machine 70. As is shown in FIG. 4, the user interface 84 may include a display 85, such as a liquid crystal display (LCD) or active matrix display, alphanumeric display or cathode ray tube-type display (e.g., emissive display), for example. The user interface 84 may further include a Web/Internet interface for communicating data, files, email, and the like between the boring machine and Internet users/sites, such as a central control site or remote maintenance facility. Diagnostic and/or performance data, for example, may be analyzed from a remote site or downloaded to the remote site via the Web/Internet interface. Software updates, by way of further example, may be transferred to the boring machine or boring tool electronics package from a remote site via the Web/Internet interface. It is understood that a secured (e.g., non-public) communication link may also be employed to effect communications between a remote site and the boring machine/boring tool.

The portion of display 85 shown in FIG. 4 includes a display 79 which visually communicates information concerning a pre-planned boring route, such as a bore plan currently in use or one of several alternative bore plans developed or under development for a particular site. During or subsequent to a boring operation, information concerning the actual boring route is graphically presented on the display 77. When used during a boring operation, an operator may view both the pre-planned boring route display 79 and actual boring route display 77 to assess the progress and accuracy of the boring operation. Deviations in the actual boring route, whether user initiated or central processor initiated, may be highlighted or otherwise accentuated on the actual boring route display 77 to visually alert the operator of such deviations. An audible alert signal may also be generated.

It is understood that the display of an actual bore path may be superimposed over a pre-planned bore path and displayed on the same display, rather than on individual displays. Further, the displays 77 and 79 may constitute two display windows of a single physical display. It is also understood that any type of view may be generated as needed, such as a top, side or perspective view, such as view with respect to the drill or the tip of the boring tool, or an oblique, isometric, or orthographic view, for example.

It can be appreciated that the data displayed on the pre-planned and actual boring route displays 79 and 77 may be used to construct an "as-built" bore path data set and a path deviation data set reflective of deviations between the pre-planned and actual bore paths. The as-built data typically includes data concerning the actual bore path in three dimensions (e.g., x-, y-, z-planes), entrance and exit pit locations, diameter of the pilot borehole and backreamed borehole, all obstacles, including those detected previously to or during the boring operation, water regions, and other related data. Geophysical/geological data gathered prior, during or subsequent to the boring operation may also be included as part of the as-built data.

Figure 5:
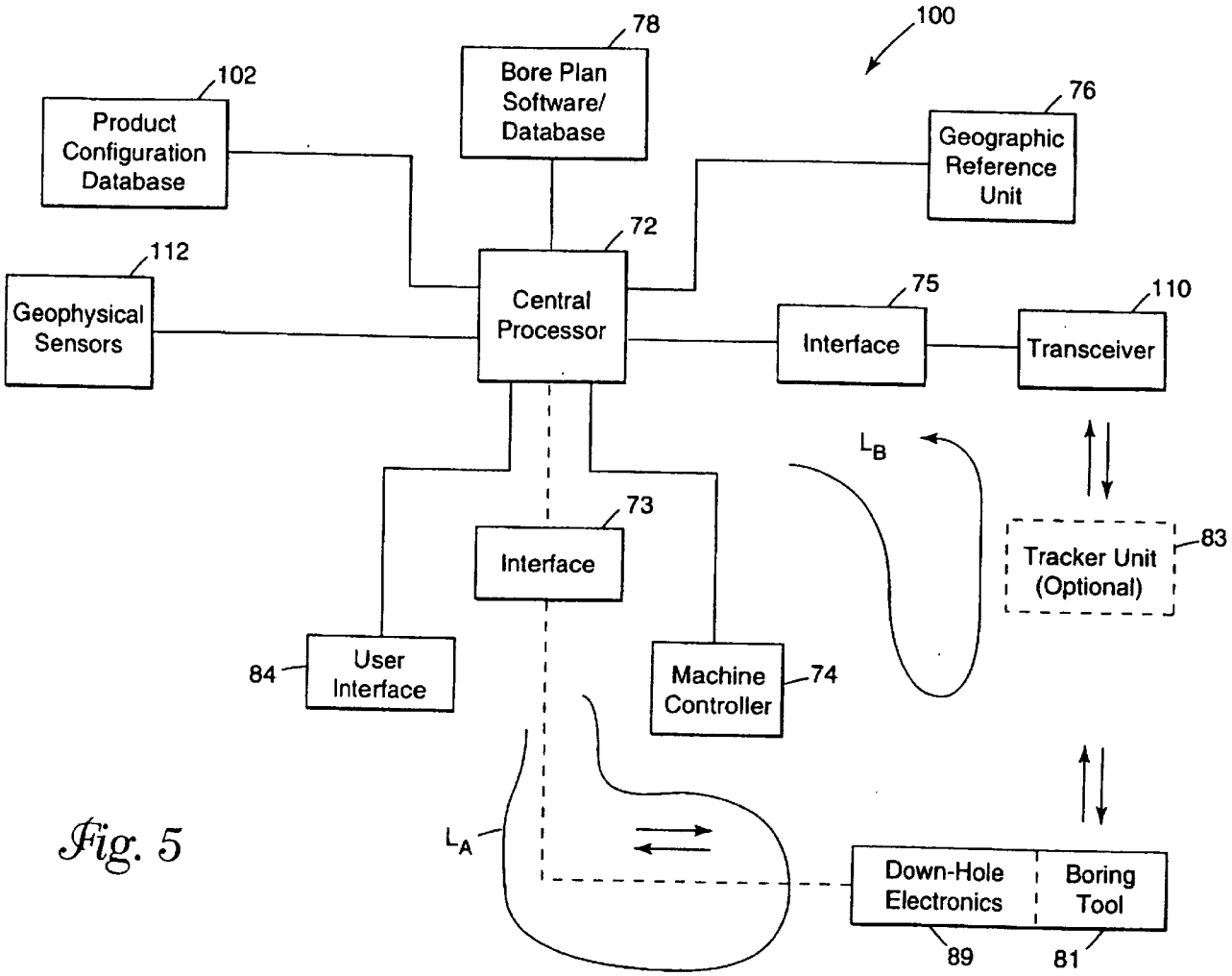
FIG. 5 is a block diagram of a system for controlling operations of a boring machine and boring tool in real-time according to an embodiment of the present invention.

FIG. 5 is a block diagram of a system 100 for controlling, in real-time, various operations of a boring machine and a boring tool which incorporates a down-hole sensor unit according to an embodiment of the present invention. With respect to control loop $L_A$, the system 100 includes an interface 73 that permits the system 100 to accommodate different types of sensor packages 89, including packages that incorporate magnetometers, accelerometer rate sensors, various boring tool geophysical/environmental instruments and sensors, and telemetry methodologies. The interface 73 may comprise both hardware and software elements that may be modified, either adaptively or manually, to provide compatibility between the boring tool sensor and communications components and the central processor components of the boring system 100. In one embodiment, the interface 73 may be adaptively configured to accommodate the mechanical, electrical, and data communication specifications of the boring tool electronics. In this regard, the interface 73 eliminates or significantly reduces technology dependencies that may otherwise require a multiplicity of specialized interfaces for accommodating a corresponding multiplicity of boring tool configurations.

With respect to control loop $L_B$, an interface 75 permits the system 100 to accommodate different types of locator and tracking systems, walkover units, boring tool geophysical/environmental instruments and sensors, and telemetry methodologies. Like the interface 73 associated with control loop $L_A$, the interface 75 may comprise both hardware and software elements that may be modified, either adaptively or manually, to provide compatibility between the tracker unit/boring tool components and the central processor components of the boring system 100. The interface 75 may be adaptively configured to accommodate the mechanical, electrical, and data communication specifications of the tracker unit and/or boring tool electronics.

In accordance with another embodiment, the central processor 72 is shown coupled to a transceiver 110 and several other sensors and devices via the interface 75 so as to define an optional control loop, $L_B$. According to this alternative embodiment, the transceiver 110 receives telemetry from the tracker unit 83 and communicates this information to the central processor 72. The transceiver 110 may also communicate signals from the central processor 72 or other process of system 100 to the tracker unit 83, such as boring tool configuration commands, diagnostic polling commands, software download commands and the like. In accordance with one less-complex embodiment, transceiver 110 may be replaced by a receiver capable of receiving, but not transmitting, data.

Using the telemetry data received from the down-hole sensor unit 89 at the boring tool 81 and, if desired, drill string displacement data, the central processor 72 computes the range and position of the boring tool 81 relative to a ground level or other pre-established reference location. The central processor 72 may also compute the absolute position and elevation of the boring tool 81, such as by use of known GPS-like techniques. Using the boring tool telemetry data received from the tracker unit 83, the central processor 72 also computes one or more of the pitch, yaw, and roll (p, y, r) of the boring tool 81. Depth of the boring tool may also be determined based on the strength of an electromagnetic sonde signal transmitted from the boring tool. It is noted that pitch, yaw, and roll may also be computed by the down-hole sensor unit 89, alone or in cooperation with the central processor 72. Suitable techniques for determining the position and/or orientation of the boring tool 81 may involve the reception of a sonde-type telemetry signal (e.g., radio frequency (RF), magnetic, or acoustic signal) transmitted from the down-hole sensor unit 89 of the boring tool 81.

In accordance with one embodiment, a mobile tracker apparatus may used to manually track and locate the progress of the boring tool 81 which is equipped with a transmitter that generates a sonde signal. The tracker 83, in cooperation with the central processor 72, locates the relative and/or absolute location of the boring tool 81. Examples of such known locator techniques are disclosed in U.S. Pat. Nos. 5,767,678; 5,764,062; 5,698,981; 5,633,589; 5,469,155; 5,337,002; and 4,907,658; all of which are hereby incorporated herein by reference in their respective entireties. These systems and techniques may be advantageously adapted for inclusion in a real-time boring tool locating approach consistent with the teachings and principles of the present invention.

A suitable technique for determining the position and/or orientation of the boring tool 81 using a handheld tracker unit involves the use of accelerometers and magnetometers incorporated in the down-hole sensor unit 89 of the boring tool 81. According to this embodiment, the down-hole sensor unit 89 of the boring tool 81 is equipped with a triaxial magnetometer, a triaxial accelerometer, and a magnetic dipole antenna for emitting an electromagnetic dipole field, the process of which is disclosed in U.S. Pat. No. 5,585,726, which is hereby incorporated herein by reference in its entirety. Signals produced by the triaxial magnetometer and triaxial accelerometer are transmitted from the boring tool 81 via the dipole antenna and received by the tracker unit 83 which processor the received signals or, alternatively, relays the signals to the transceiver 110 of the boring system. The received signals are used by the central processor to compute the orientation and, using boring tool displacement data, the location of the boring tool 81, although the orientation of the boring tool 81 may be computed directly by the tracker unit 83

The approximate position of the boring tool 81 may be computed during a boring operation by performing an integration of the signals over the distance the boring tool 81 has traveled. The tracker unit 83, which is typically implemented as a portable or hand-held unit, continuously receives telemetry signals from the boring tool transmitter by detecting the electromagnetic dipole field emitted by the boring tool 81. The actual position of the boring tool 81, as determined by using the locator telemetry data, is used to correct for any integration error that may have been introduced into the integration computation. In another embodiment, boring tool position and orientation is detected by the tracker unit 83. As such, the actual position of the boring tool 81 may be computed by the tracker unit 83 rather than at the boring machine location. The location/orientation data is processed by the central processor 72 to provide closed-loop control of the boring tool 81 during a boring operation.

Yet another technique for determining the position and/or orientation of the boring tool 81 involves the use of a tracker unit 83 comprising several spaced-apart antenna cells situated along one or both sides of a pre-planned bore path. This embodiment advantageously obviates the need of a locator operator. A transmitter provided in the boring tool 81 transmits a signal which is received by the antenna cell network. The boring tool signal is relayed along the antenna cell links and is received by a transceiver coupled to the central processor 72 for processing by the central processor 72. The central processor 72 computes the actual location of the boring tool 81 and compares the actual location with a pre-planned location according to a predetermined underground path stored in the bore plan database 78. The machine controller 74 initiates any required course correction, in real-time, resulting from a deviation between the actual and pre-planned boring tool locations. A system well-suited for use according to this embodiment is the TRANSITRAK iGPS system manufactured by Digital Controls, Inc. of Renton, Wash. It will be appreciated that techniques other than those described herein for determining boring tool location and orientation may be employed to provide location and orientation signals to the central processor 72 for purposes of controlling boring tool activity in a closed-loop, real-time operating environment.

In accordance with another embodiment of the present invention, location unit 83 employs an apparatus that determines the location and orientation of the boring tool 81 by employment of a radar-like probe and detection technique. Suitable techniques for determining the position and/or orientation of the boring tool 81 using a ground penetrating radar approach are disclosed in commonly assigned U.S. Pat. Nos. 5,720,354 and 5,904,210, both of which are incorporated herein by reference in their respective entireties. The boring tool 83, according to this embodiment, is provided with a device which generates a specific signature signal in response to a probe signal transmitted from the tracker unit 83. Cooperation between the probe signal transmitter provided at the tracker unit 83 and the signature signal generating device provided at the boring tool 81 results in accurate detection of the boring tool location and, if desired, orientation, despite the presence of a large background signal.

Precision detection of the boring tool location and orientation enables the operator to accurately locate the boring tool during operation and, if provided with a directional capability, avoid buried obstacles such as utilities and other hazards. The signature signal produced by the boring tool 81 may be generated either passively or actively, and may be a microwave or an acoustic signal. Further, the signature signal may be produced in a manner which differs from that used to produce the probe signal in one or more ways, including timing, frequency content, information content, or polarization.

Figure 19:
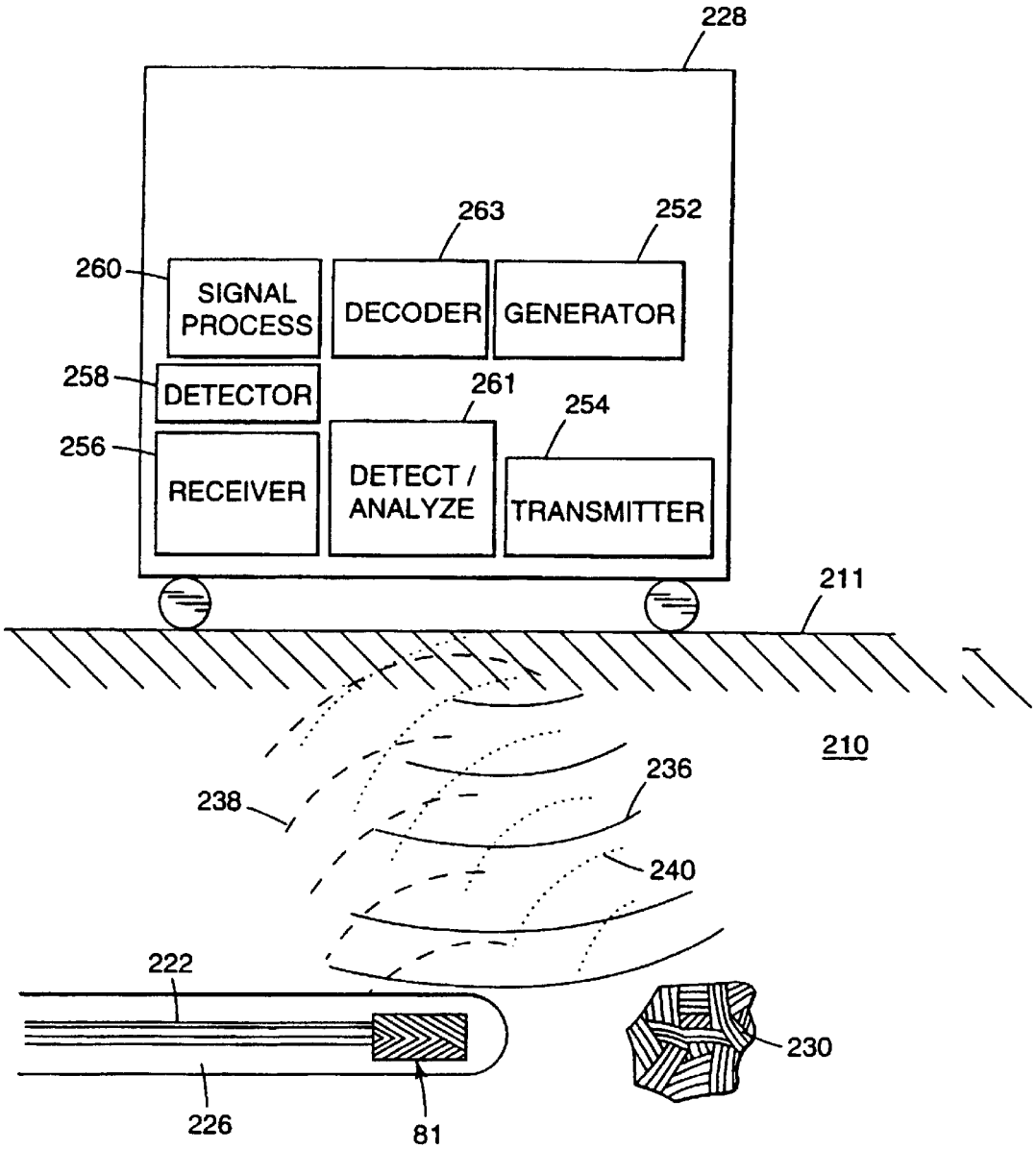
FIG. 19 is a depiction of a locating/tracking unit that employs an apparatus for determining the location and orientation of a boring tool by employment of a radar-like probe and detection technique in accordance with an embodiment of the present invention.

According to this embodiment, and with reference to FIG. 19, tracker unit 83 comprises a detection unit 228 which includes a receiver 256, a detector 258, and a signal processor 260. The receiver 256 receives return signals from the ground 210 and communicates them to the detector 258. The detector 258 converts the return signals into electrical signals which are subsequently analyzed in the signal processing unit 260. In a first embodiment in which a probe signal 236 produced by generator 252 constitutes a microwave signal, the receiver 256 typically includes an antenna, and the detector 258 typically includes a detection diode. In a second embodiment in which the probe signal 236 constitutes an acoustic wave, the receiver 256 typically is a probe which makes good mechanical contact with the ground 210 and the detector 258 includes a sound-to-electrical transducer, such as microphone.

The signal processor 260 may include various preliminary components, such as a signal amplifier, a filtering circuit, and an analog-to-digital converter, followed by more complex circuitry for producing a two or three dimensional image of a subsurface volume which incorporates the various underground obstructions 230 and the boring tool 81. The detection unit 228 may also contain a beacon receiver/analyzer 261 for detecting and interpreting a signal received from an active beacon or sonde provided in the boring tool 81. The signal transmitted by the active beacon may include information concerning the orientation and/or the environment of the boring tool 81, which is decoded by the beacon receiver/analyzer 261.

The detection unit 228 also contains a decoder 263 for decoding information signal content that may be encoded on the signature signal produced by the boring tool 81. Orientation, pressure, temperature, and geophysical information, for example, may be sensed by appropriate sensors provided in the boring tool 81, such as a strain gauge for sensing pressure, a mercury switch for detecting orientation, a pitch sensor for measuring boring tool pitch, a GPR sub-system or one or more geophysical sensors. Such information may be encoded on the signature signal, such as by modulating the signature signal with an information signal, or otherwise transmitted as part of, or separate from, the signature signal. When received by the receiver 256, an encoded return signal is decoded by the decoder 261 to extract the information signal content from the signature signal content. It is noted that the components of the detection unit 228 illustrated in FIG. 19 need not be contained within the same housing or supporting structure.

The detection unit 228 transmits acquired information along a data transmission link to the central processor 72. The data transmission link is provided to handle the transfer of data between the detection unit 228 of the tracker unit 83 and the transceiver of the boring system, and may be a co-axial cable, an optical fiber, a free-space link for infrared or microwave communication, or some other suitable data transfer medium or technique.

A boring system of the present provides the opportunity to conduct a boring operation in a variety of different modes. By way of example, a walk-the-path mode of operation involves initially walking along a desired bore path and making a recordation of the desired path. An operator may use a hand-held GPS-type unit, for example, to geographically define the bore path. Alternatively, the operator may use a down-hole sensor unit similar to that used with the boring tool to map the desired bore path. Moreover, the operator may use the same down-hole sensor unit as that used during the boring operation to establish the desired bore path.

After walking the desired bore path, the stored bore path data may be uploaded to the central processor or to a PC which executes bore plan software to produce a machine usable bore plan. The hand-held unit may also be provided with data processing and display resources necessary to execute bore plan software for purposes of producing a machine usable bore plan. The bore plan software allows the operator to further refine and modify a bore plan based on the previously acquired bore path data. The operator interacts with the bore plan software, as will be discussed in greater detail hereinbelow, to define the depth of the bore path, entry points, exit points, targets, and other features of the bore plan.

Another mode of operation involves a so called walk-the-dog method by which an operator walks above the boring tool with a portable tracker unit. The tracker unit is provided with steering controls which allow the operator to initiate boring tool steering changes as desired. The boring tool, according to this embodiment, is provided with electronics which enables it to receive the steering commands transmitted by the tracker unit, compute, in-situ, appropriate steering control signals in response to the steering command, and transmit the steering commands to the boring machine to effect the desired steering change. In this regard, all boring tool steering changes are made by the down range operator walking above the boring tool, and not by the boring machine operator.

In accordance with yet another mode of boring machine operation, a steer-by-tool approach involves the transmission of a signal at an aboveground target along the bore path, it being understood that the signal may be transmitted by an underground target. The boring tool detects the target signal and computes, in-situ, the necessary steering commands to direct the boring tool to the target signal. Any steering changes that are necessary, such as deviations needed to avoid underground obstructions or undesirable geology, are effected by steering commands produced by the down-hole electronics. The boring tool electronics computes the steering changes needed to successfully steer the boring tool around the obstruction and to the target signal. The boring tool electronics may execute bore plan software to recompute a bore plan when changes to the bore plan are required for reasons of safety or productivity.

According to another mode of operation, a smart-tool approach involves downloading a bore plan into the boring tool electronics. The boring tool electronics computes all steering changes needed to maintain the boring tool along the predetermined bore path. An operator, however, may override a currently executing bore plan by terminating the drilling operation at the boring machine of via a tracker unit. A new or replacement bore plan may then be downloaded to the boring tool for execution.

Figure 6:
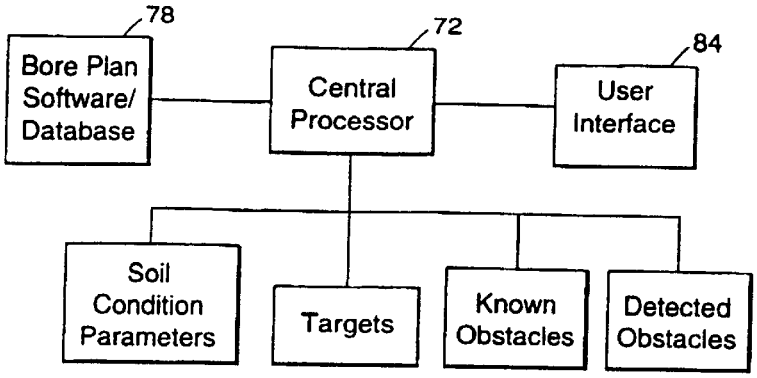
FIG. 6 is a block diagram depicting a bore plan software and database facility which is accessed by a controller for purposes of establishing a bore plan, storing and modifying the bore plan, and accessing the bore plan during a boring operation according to an embodiment of the present invention.

Turning now to FIG. 6, a bore plan database/software facility 78 may be accessed by or incorporated into the central processor 72 for purposes of establishing a bore plan, storing a bore plan, and accessing a bore plan during a boring operation. A user, such as a bore plan designer or boring machine operator, may access the bore plan database 78 via a user interface 84. In a configuration in which the central processor 72 cooperates with a computer external to the boring machine, such as a personal computer, the user interface 84 typically comprises a user input device (e.g., keyboard, mouse, etc.) and a display. In a configuration in which the central processor 72 is used to execute the bore plan algorithms or interact with the bore plan database 78, the user interface 84 comprises a user input device and display provided on the boring machine or as part of the central processor housing.

A bore plan may be designed, evaluated, and modified efficiently and accurately using bore plan software executed by the central processor 72. Alternatively, a bore plan may be developed using a computer system independent of the boring machine and subsequently uploaded to the bore plan database 78 for execution and/or modification by the central processor 72. Once established, a bore plan stored in the bore plan database 78 may be accessed by the central processor 72 for use during a boring operation. In general, a bore plan may be designed such that the drill string is as short as possible. A bore should remain a safe distance away from underground utilities to avoid strikes. The drill path should turn gradually so that stress on the drill string and product to be installed in the borehole is minimized. The bore plan should also consider whether a given utility requires a minimum ground cover.

A bore plan designer may enter various types of information to define a particular bore plan. A designer initially constructs the general topography of a given bore site. In this context, topography refers to a two-dimensional representation of the earth's surface which is defined in terms of distance and height values. Alternatively, the designer may initially construct the general topography of a given bore site in three dimensions. In this context, topography refers to a three-dimensional representation of the earth's surface.

The topography of a region of interest is established by entering a series of two-dimensional points or, alternatively, three-dimensional points. The bore plan software sorts the points based on distance, and connects them with straight lines. As such, each topographical point has a unique distance associated with it. The bore plan software determines the height of the surface for any distance between two topographical points using linear interpolation between the nearest two points. Topography is used to set the scope (i.e., upper and lower distance bounds) of the graphical display. Establishing the topography provides for the generation of a graphical representation of the bore site.

After establishing the topography, the bore plan designer selects a reference origin, which corresponds to a distance, height, and left/right value relative to a reference value, such as zero. The designer may then select a reference line that runs through the reference origin. The reference line is typically established to be in the general direction of the borehole, horizontal, and straight. The designer may also enter the longitude, latitude, and altitude of the local reference origin and the bearing of the reference line to provided for absolute geographic location determinations. Once the reference system is established, the designer can uniquely define a number of three-dimensional locations to define the bore path, including the distance from the origin along the reference line in the positive direction, the height above the reference line and origin, and locations left and right of the reference line in the positive distance direction. Direction may also be uniquely specified by entering an azimuth value, which refers to a horizontal angle to the left of the reference line when viewed from the origin facing in the positive distance direction, and a pitch value, which refers to a vertical angle above the reference line.

Objects, such as existing utilities, obstructions, obstacles, water regions, and the like, may be defined with reference to the surface of the earth. These points may be specified using a depth of object value relative to the earth surface and the height of the object. The characteristics of the drill string rods, such as maximum bend radius, and of the product to be pulled through the borehole during a backreaming operation, such as a utility conduit, may be entered by the designer or obtained from a product configuration databases 102 as is shown in FIG. 5. Dimensions, maximum bend radii, material composition, and other characteristics of a given product may be considered during the bore path planning process. For example, the product pulled through a borehole during a backreaming operation will have a diameter greater than that of the pilot bore, and the product will often have bending characteristics different from those associated with the drill string rods. These and other factors may affect the size and configuration and curvature of a given borehole, and as such, may be entered as input data into the bore path plan. The designer may also input soil/rock composition and geophysical characteristics data associated with a given bore site. Data concerning soil/rock hardness, composition, and the like may be entered and subsequently considered by the bore plan software.

After entering all applicable objects associated with a desired bore path, the designer enters a number of targets through which the bore path will pass. Targets have an associated three-dimensional location defined by distance, left/right, and depth values that are entered by the operator. The designer may optionally enter pitch and/or azimuth values at which the bore path should pass. The designer may also assign bend radius characteristics to a bore segment by entering values of the maximum bend radius and minimum bend radius sections for a destination target.

Using the data entered by the bore plan designer and other stored data applicable to a given bore path plan, the central processor 72 connects each target pair using course computations determined at steps separated by a preestablished spacing, such as 25 cm spaced steps. At each step, the central processor 72 calculates the direction the bore path should take so that the bore path passes through the next target without violating any of the preestablished conditions. The central processor 72 thus mathematically constructs the bore path in an incremental fashion until the exit pit location is reached. If a preestablished condition, such as drill rod bend radius, is violated, the error condition is communicated to the designer. The designer may then modify the bore plan to satisfy the particular preestablished condition.

In a further embodiment, a preestablished bore plan may be dynamically modified during a boring operation upon detection of an unknown obstacle or upon boring through soil/rock which significantly degrades the steering and/or excavation capabilities of the boring tool. Upon detecting either of these conditions, the central processor 72 attempts to compute a "best fit" alternative bore path "on-the-fly" that passes as closely as possible to subsequent targets. Detection of an unidentified or unknown obstruction is communicated to the operator, as well as a message that an alternative bore plan is being computed. If the alternative bore plan is determined valid, then the boring tool is advanced uninterrupted along the newly computed alternative bore path. If a valid alternative bore path cannot be computed, the central processor 72 halts the boring operation and communicates an appropriate warning message to the operator.

During a boring operation, as was discussed previously, bore plan data stored in the bore plan database 78 may be accessed by the central processor 72 to determine whether an actual bore path is accurately tracking the planned bore path. Real-time course corrections may be made by the machine controller 74 upon detecting a deviation between the planned and actual bore paths. The actual boring tool location may be displayed for comparison against a display of the preplanned boring tool location, such as on the actual and pre-panned boring route displays 77 and 79 shown in FIG. 4. As-built data concerning the actual bore path may be entered manually or automatically from data downloaded directly from a tracker unit, such as from the tracker unit 83. Alternatively, as-built data concerning the actual bore path may be constructed based on the trajectory information received from the navigation electronics provided at the boring tool 81. A bore plan design methodology particularly well-suited for use with the real-time central processor of the present invention is disclosed in co-owned U.S. Serial No. 60/115,880 entitled "Bore Planning System and Method," filed Jan. 13, 1999, which is hereby incorporated herein by reference in its entirety.

With continued reference to FIG. 5, the system 100 may include one or more geophysical sensors 112, including a GPR imaging unit, a capacitive sensor, acoustic sensor, ultrasonic sensor, seismic sensor, resistive sensor, and electromagnetic sensor, for example. In accordance with one embodiment, surveying the boring site, either prior to or during the boring operation, with geophysical sensors 112 provides for the production of data representative of various characteristics of the ground medium subjected to the survey. The ground characteristic data acquired by the geophysical sensors 112 during the survey may be processed by the central processor 72, which may modify boring machine activities in order to optimize boring tool productivity given the geophysical makeup of the soil/rock at the boring site.

The central processor 72 receives data from a number of geophysical instruments which provide a physical characterization of the geology for a particular boring site. The geophysical instruments may be provided on the boring machine, provide in one or more instrument packs separate from the boring machine or provided in, on, or proximate the boring tool 81. A seismic mapping instrument, from example, represents an electronic device consisting of multiple geophysical pressure sensors. A network of these sensors may be arranged in a specific orientation with respect to the boring machine, with each sensor being situated so as to make direct contact with the ground. The network of sensors measures ground pressure waves produced by the boring tool 81 or some other acoustic source. Analysis of ground pressure waves received by the network of sensors provides a basis for determining the physical characteristics of the subsurface at the boring site and also for locating the boring tool 81. These data are processed by the central processor 72.

A point load tester represents another type of geophysical sensor 112 that may be employed to determine the geophysical characteristics of the subsurface at the boring site. The point load tester employs a plurality of conical bits for the loading points which, in turn, are brought into contact with the ground to test the degree to which a particular subsurface can resist a calibrated level of loading. The data acquired by the point load tester provide information corresponding to the geophysical mechanics of the soil/rock under test. These data may also be transmitted to the central processor 72.

Another type of geophysical sensor 112 is referred to as a Schmidt hammer which is a geophysical instrument that measures the rebound hardness characteristics of a sampled subsurface geology. Other geophysical instruments 112 may also be employed to measure the relative energy absorption characteristics of a rock mass, abrasivity, rock volume, rock quality, and other physical characteristics that together provide information regarding the relative difficulty associated with boring through a given geology. The data acquired by the Schmidt hammer are also received and processed by the central processor 72.

Figure 7:
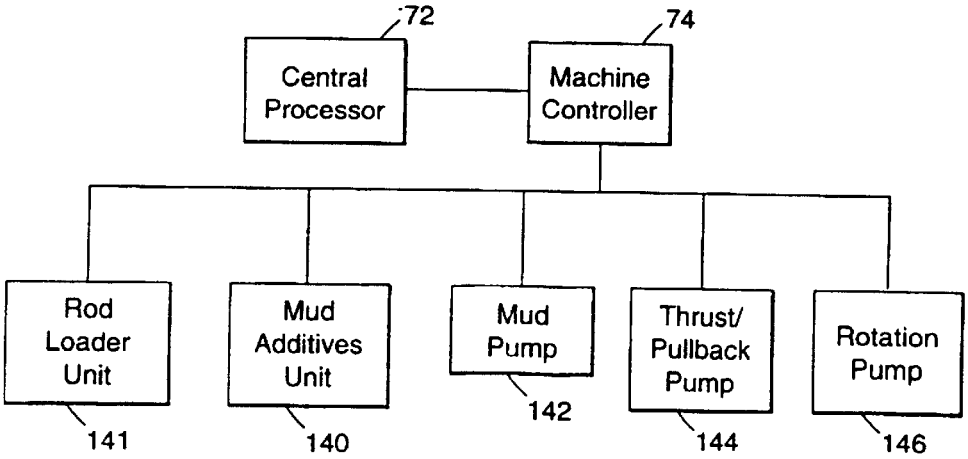
FIG. 7 is a block diagram of a machine controller which is coupled to a central controller and a number of pumps/devices which cooperate to modify boring machine operation in response to control signals received from a central controller according to an embodiment of the present invention.

As is shown in FIGS. 5 and 7, a machine controller 74 is coupled to the central processor 72 and modifies boring machine operations in response to control signals received from the central processor 72. Alternatively, some or all of the machine controller functionality may be integrated into and/or performed by the central processor 72. As is best shown in FIG. 7, the machine controller 74 controls a rotation pump or motor 146, referred to hereinafter as a rotation pump, that rotates the drill string during a boring operation. The machine controller 74 also controls the rotation pump 146 during automatic threading of rods to the drill string. A pipe loading controller 141 may be employed to control an automatic rod loader apparatus during rod threading and unthreading operations. The machine controller 74 also controls a thrust/pullback pump or motor 144, referred to hereinafter as a thrust/pullback pump. The machine controller 74 controls the thrust/pullback pump 144 during boring and backreaming operations to moderate the forward and reverse displacement of the boring tool.

Figure 8:
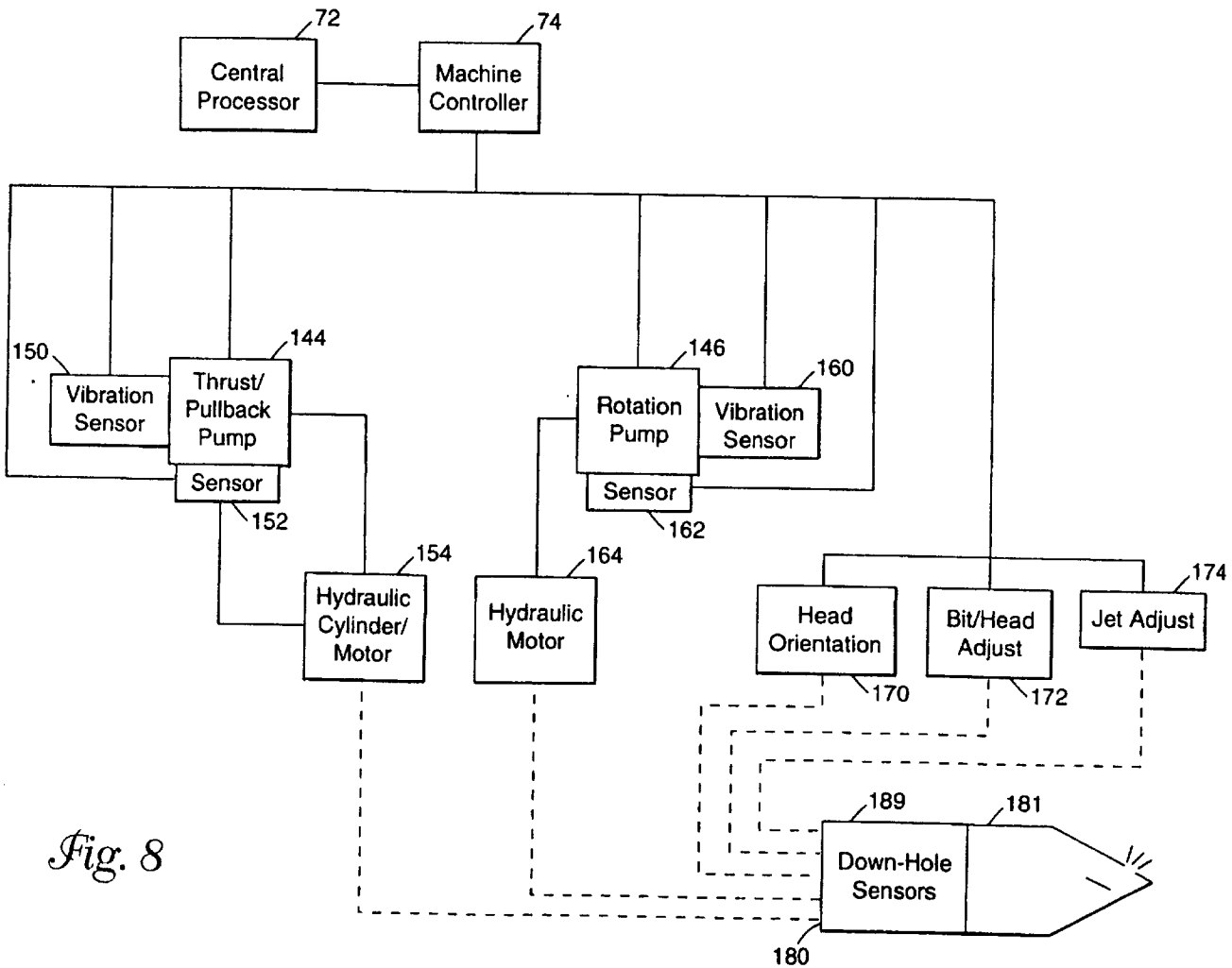
FIG. 8 is a detailed block diagram of a control system for controlling the rotation, displacement, and direction of an underground boring tool according to an embodiment of the present invention.

The thrust/pullback pump 144 depicted in FIG. 8 drives a hydraulic cylinder 154, or a hydraulic motor, which applies an axially directed force to a length of pipe 180 in either a forward or reverse axial direction. The thrust/pullback pump 144 provides varying levels of controlled force when thrusting a length of pipe 180 into the ground to create a borehole and when pulling back on the pipe length 180 when extracting the pipe 180 from the borehole during a back reaming operation. The rotation pump 146, which drives a rotation motor 164, provides varying levels of controlled rotation to a length of the pipe 180 as the pipe length 180 is thrust into a borehole when operating the boring machine in a drilling mode of operation, and for rotating the pipe length 180 when extracting the pipe 180 from the borehole when operating the boring machine in a back reaming mode. Sensors 152 and 162 monitor the pressure of the thrust/pullback pump 144 and rotation pump 146, respectively. The machine controller 74 also controls rotation pump movement when threading a length of pipe onto a drill string 180, such as by use of an automatic rod loader apparatus of the type disclosed in commonly assigned U.S. Pat. No. 5,556,253, which is hereby incorporated herein by reference in its entirety. An engine or motor (not shown) provides power, typically in the form of pressure, to both the thrust/pullback pump 144 and the rotation pump 146, although each of the pumps 144 and 146 may be powered by separate engines or motors.

In accordance with one embodiment for controlling the boring machine using a closed-loop, real-time control methodology of the present invention, overall boring efficiency may be optimized by appropriately controlling the respective output levels of the rotation pump 146 and the thrust/pullback pump 144. Under dynamically changing boring conditions, closed-loop control of the thrust/pullback and rotation pumps 144 and 146 provides for substantially increased boring efficiency over a manually controlled methodology. Within the context of a hydrostatically powered boring machine or, alternatively, one powered by proportional valve-controlled gear pumps or electric motors, increased boring efficiency is achievable by rotating the boring tool 181 at a selected rate, monitoring the pressure of the rotation pump 146, and modifying the rate of boring tool displacement in an axial direction with respect to an underground path while concurrently rotating the boring tool 181 at the selected output level in order to compensate for changes in the pressure of the rotation pump 146. Sensors 152 and 162 monitor the pressure of the thrust/pullback pump 144 and rotation pump 146, respectively.

In accordance with one mode of operation, an operator initially sets a rotation pump control to an estimated optimum rotation setting during a boring operation and modifies the setting of a thrust/pullback pump control in order to change the gross rate at which the boring tool 181 is displaced along an underground path when drilling or back reaming. The rate at which the boring tool 181 is displaced along the underground path during drilling or back reaming typically varies as a function of soil/rock conditions, length of drill pipe 180, fluid flow through the drill string 180 and boring tool 181, and other factors. Such variations in displacement rate typically result in corresponding changes in rotation and thrust/pullback pump pressures, as well as changes in engine/motor loading. Although the rotation and thrust/pullback pump controls permit an operator to modify the output of the thrust/pullback and rotation pumps 144 and 146 on a gross scale, those skilled in the art can appreciate the inability by even a highly skilled operator to quickly and optimally modify boring tool productivity under continuously changing soil/rock and loading conditions.

After initially setting the rotation pump control to the estimated optimum rotation setting for the current boring conditions, an operator controls the gross rate of displacement of the boring tool 181 along an underground path by modifying the setting of the thrust/pullback pump control. During a drilling or back reaming operation, the rotation pump sensor 162 monitors the pressure of the rotation pump 146, and communicates rotation pump pressure information to the machine controller 74. The rotation pump sensor 162 may alternatively communicate rotation motor speed information to the machine controller 74 in a configuration which employs a rotation motor rather than a pump. Excessive levels of boring tool loading during drilling or back reaming typically result in an increase in the rotation pump pressure, or, alternatively, a reduction in rotation motor speed.

In response to an excessive rotation pump pressure or, alternatively, an excessive drop in rotation rate, the machine controller 74 communicates a control signal to the thrust/pullback pump 144 resulting in a reduction in thrust/pullback pump pressure so as to reduce the rate of boring tool displacement along the underground path. The reduction in the force of boring tool displacement decreases the loading on the boring tool 181 while permitting the rotation pump 146 to operate at an optimum output level or other output level selected by the operator.

It will be understood that the machine controller 74 may optimize boring tool productivity based on other parameters, such as torque imparted to the drill string via the rotation pump 146. For example, the operator may select a desired rotation and thrust/pullback output for a particular boring operation. The machine controller 74 monitors the torque imparted to the drill string at the gearbox and modifies one or both of the rotation and thrust/pullback pumps 146, 144 so that the drill string torque does not exceed a pre-established limit.

The phenomenon of drill string buckling may also be detected and addressed by the machine controller 74 when controlling a boring operation. Drill string buckling typically occurs in soft soils and is associated with movement of the gearbox and the contemporaneous absence of boring tool movement in a longitudinal direction. Appreciable movement of the gearbox and a detected lack of appreciable longitudinal movement of the boring tool may indicate the occurrence of undesirable drill string buckling. The machine controller 74 may monitor gearbox movement and longitudinal movement of the boring tool in order to detect and correct for drill string buckling.

The machine controller 74 further moderates the pullback force during a backreaming operation to avoid overstressing the installation product being pulled back through the borehole. Strain or force measuring devices may be provided between the backreamer and the installation product to measure the pullback force experienced by the installation product. Strain/force sensors may also be situated on the product itself. The machine controller 74 may modify the operation of the thrust/pullback pump 144 to ensure that the actual product stress level, as indicated by the strain/force sensors, does not exceed a pre-established threshold.

The machine controller 74 may also control the pressure of the rotation pump 146 in both forward and reverse (e.g., clockwise and counterclockwise) directions. When drilling through soil or rock, the machine controller 74 controls the rotation pump pressure to controllably rotate the drill string/boring tool in a first direction during cutting and steering operations. The machine controller 74 also controls the rotation pump pressure to controllably rotate the drill string in a second direction so as to prevent unthreading of the drill string. Preventing unthreading of the drill string is particularly important when cutting with rock boring heads that require a rocking action for improved productivity.

Another system capability involves the detection of utility/obstacle punctures or penetration events. An appreciable drop in thrust and/or rotation pump pressure may occur when the boring tool passes through a utility, in comparison to pump pressures experienced prior to and after striking the utility. If an appreciable drop in thrust and/or rotation pump pressure is detected, the machine controller 74 may halt drilling operations and alert the operator as to the possible utility contact event. The machine controller 74 may further monitor thrust and/or rotation pump pressure for pressure spikes followed by a drop in thrust and/or rotation pump pressure, which may also indicate the occurrence of a utility contact event.

The high speed response capability of the machine controller 74 in cooperation with the central processor 72 provides for real-time automatic moderation of the operation of the boring machine under varying loading conditions, which provides for optimized boring efficiency, reduced detrimental wear-and-tear on the boring tool 181, drill string 180, and boring machine pumps and motors, and reduced operator fatigue by automatically modifying boring machine operations in response to both subtle and dramatic changes in soil/rock and loading conditions. An exemplary methodology for controlling the displacement and rotation of a boring tool which may be adapted for use in a closed-loop control approach consistent with the principles of the present invention is disclosed in commonly assigned U.S. Pat. No. 5,746,278, which is hereby incorporated herein by reference in its entirety.

With continued reference to FIG. 8, a vibration sensor 150, 160 may be coupled to each of the thrust/pullback pump 144 and rotation pump 146 for purposes of monitoring the magnitude of pump vibration that typically occurs during operation. Other vibration sensors (not shown) may be mounted to the chassis or other structure for purposes of detecting displacement or rotation of the boring system chassis or high levels of chassis vibration during a boring operation. It is appreciated by the skilled boring machine operator that pump/motor/chassis vibration is a useful sensory input that is often considered when manually controlling the boring machine.

Changes in the magnitude of pump/chassis vibration as felt by the operator is typically indicative of a change in pump loading or pressure, such as when the boring tool is passing through cobblestone. Pump/motor/chassis vibration, which has heretofore been ignored in conventional control schemes, may be monitored using pump vibration sensors 150, 160 and one or more chassis vibration sensors, converted to corresponding electrical signals, and communicated to respective thrust/pullback and rotation controllers 124, 126. The transduced pump/chassis vibration data may be transmitted to the machine controller 74 and used to adjust the output of the thrust/pullback and rotation pumps 144, 146.

By way of example, a vibration threshold may be established using empirical means for each of the thrust/pullback and rotation pumps 144, 146 respectively mounted on a given boring machine chassis. The vibration threshold values are typically established with the respective pumps 144, 146 mounted on the boring machine, since the boring machine chassis influences that vibratory characteristics of the thrust/pullback and rotation pumps 144, 146 during operation. A vibration threshold typically represents a level of vibration which is considered detrimental to a given pump. A baseline set of vibration data may thus be established for each of the thrust/pullback and rotation pumps 144, 146, and, in addition, the boring machine engine and chassis if desired.

If vibration levels as monitored by the vibration sensors 150, 160 or chassis vibration sensors during boring activity exceed a given vibration threshold, the machine controller 74 may adjust one or both of the output of the thrust/pullback and rotation pumps 144, 146 until the applicable vibration threshold is no longer exceeded. Closed-loop vibration sensing and thrust/pullback and rotation pump output compensation may thus be effected by the machine controller 74 to avoid over-stressing and damaging the thrust/pullback and rotation pumps 144, 146. A similar control approach may be implemented to compensate for excessively high levels of mud pump and engine vibration. Various known types of vibration sensors/transducers may be employed, including single or multiple accelerometers for example.

In accordance with another embodiment, an acoustic profile may be established for each of the thrust/pullback and rotation pumps 144, 146. An acoustic profile in this context represents an acoustic characterization of a given pump or motor when operating normally or, alternatively, when operating abnormally. The acoustic profile for a given boring machine component is typically developed empirically.

Acoustic sampling of a given pump or motor may be conducted on a routine basis during boring machine operation. The sampled acoustic data for a given pump or motor may then be compared to its corresponding acoustic profile. Significant differences between the acoustic sample and profile for a particular pump or motor may indicate a potential problem with the pump/motor. In an alternative embodiment, the acoustic profile may represent an acoustic characterization of a defective pump or motor. If the sampled acoustic data for a given pump/motor appears to be similar to the defective acoustic profile, the potentially defective pump/motor should be identified and subsequently evaluated. A number of known analog signal processing techniques, digital signal processing techniques, and/or pattern recognition techniques may be employed to detect suspect pumps, motors or other system components when using an acoustic profiling/sampling procedure of the present invention.

This acoustic profiling and sampling technique may be used for evaluating the operational state of a wide variety of boring machine/boring tool components. By way of example, a given boring tool may exhibit a characteristic acoustic profile when operating properly. Use of the boring tool during excavation alters the boring tool in terms of shape, size, mass, moment of inertia, and other physical aspects that impact the acoustic characteristics of the boring tool. A worn or damaged boring tool or component of the tool will thus exhibit an acoustic profile different from a new or undamaged boring tool/component. During a drilling operation, sampling of boring tool acoustics, typically by use of a microphonic or piezoelectric device, may be performed. The sampled acoustic data may then be compared with acoustic profile data developed for the given boring tool. The acoustic profile data may be representative of a boring tool in a nominal state or a defective state.

In a similar manner, the frequency characteristics of a given component may also be used as a basis for determining the state of the given component. For example, the frequency spectrum of a cutting bit during use may be obtained and evaluated. Since the frequency response of a cutting bit changes during wear, the amount of wear and general state of the cutting bit may be determined by comparing sampled frequency spectra of the cutting bit with its normal or abnormal frequency profile.

The machine controller 74 also controls the direction of the boring tool 181 during a boring operation in response to control signals received from the central processor. The machine controller 74 controls boring tool direction using one or a combination of steering techniques. In accordance with one steering approach, the orientation 170 of the boring tool 181 is determined by the machine controller 74. The boring tool 181 is rotated to a selected position and an actuator internal or external to the boring tool 181 is activated so as to urge the boring tool 181 in the desired direction.

By way of example, a fluid may be communicated through the drill string 180 and delivered to an internal actuator of the boring tool 181, such as a movable element mounted in the boring tool 181 transverse or substantially non-parallel with respect to the longitudinal axis of the drill string 180. The machine controller 74 controls the delivery of fluid impulses to the movable element in the boring tool 181 to effect the desired lateral movement. In another embodiment, one or more external actuators, such as plates or pistons for example, may be actuated by the machine controller 74 to apply a force against the side of the borehole so as to move the boring tool 181 in the desired direction.

Figure 10:
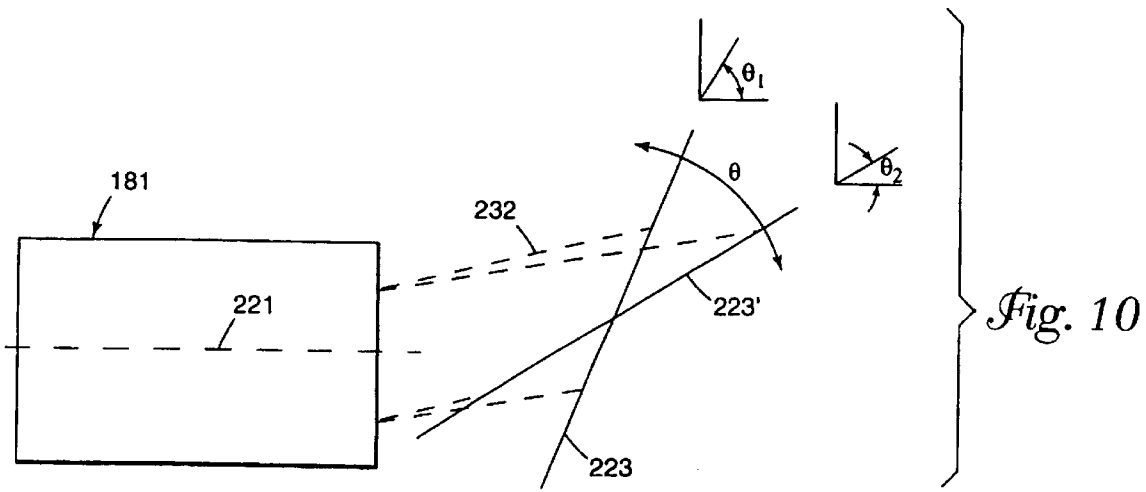
FIG. 10 illustrates an embodiment of a boring tool which includes two fluid jets, each of which is controllable in terms of jet nozzle spray direction, nozzle orifice size, fluid delivery pressure, and fluid flow rate/volume.

In accordance with the embodiment shown in FIG. 10, enhanced directional steering of the boring tool 181 is effected in part by controlling the off-axis angle, $\theta$, of a steering plate 223. Steering plate 223 may take the form of a structure often referred to in the industry as a duckbill or an adjustable plate or other member extendable from the body of the boring tool 181. The steering controller 116 may adjust the magnitude of boring tool steering changes, and thus drill string curvature, before and during a change in boring tool direction by dynamically controlling the movement of the steering plate 223.

For example, moving the steering plate 223 toward an angular orientation of $\theta_2$ relative to the longitudinal axis 221 of the boring tool 181 results in decreasing rates of off-axis boring tool displacement and a corresponding decrease in drill string curvature. Moving the steering plate 223 toward an angular orientation of $\theta_1$ relative to the longitudinal axis 221 results in increasing rates of off-axis boring tool displacement and a corresponding increase in drill string curvature. The steering plate 223 may be adjusted in terms of off-axis angle, $\theta$, and may further be adjusted in terms of displacement through angles orthogonal to off-axis angle, $\theta$. For example, movable support 232 may be rotated about an axis non-parallel to the longitudinal axis 221 of the boring tool 181 separate from or in combination with controlled changes to the off-axis angle, $\theta$, of a steering plate 223.

Figure 9:
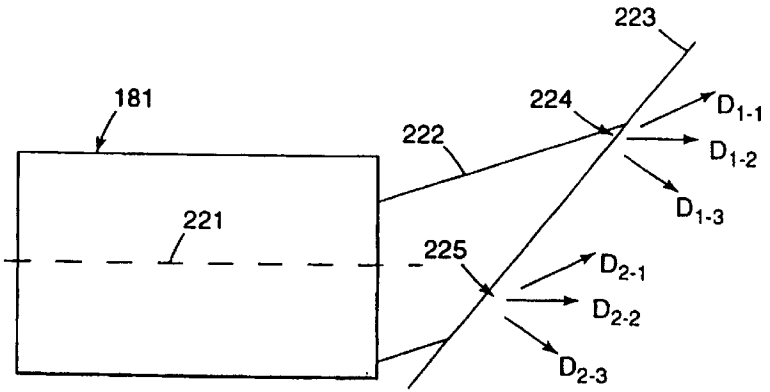
FIG. 9 depicts an embodiment of a boring tool which includes an adjustable steering plate which may take the form of a duckbill or an adjustable plate or other member extendable from the body of the boring tool.

In accordance with another embodiment, steering of the boring tool 22 may be effected or enhanced by use of one or more fluid jets provided at the boring tool 181. The boring tool embodiment shown in FIG. 9 includes two fluid jets 224, 225 which are controllable in terms of jet nozzle spray direction, nozzle orifice size, fluid delivery pressure, and fluid flow rate/volume. Fluid jet 224, for example, may be controlled by steering controller 116 to deliver a pressurized jet of fluid in a desired direction, such as direction $D_{1\text{-}1}$, $D_{1\text{-}2}$ or $D_{1\text{-}3}$, for example. Fluid jet 254, separate from or in combination with fluid jet 224, may also be controlled to deliver a pressurized jet of fluid in a desired direction, such as direction $D_{2-1}$, $D_{2-2}$ or $D_{2-3}$, for example. The machine controller 74 may also adjust the size of the orifice which assists in moderating the pressure and flow rate/volume of fluid delivered through the jet nozzles 224, 225.

Figure 11:
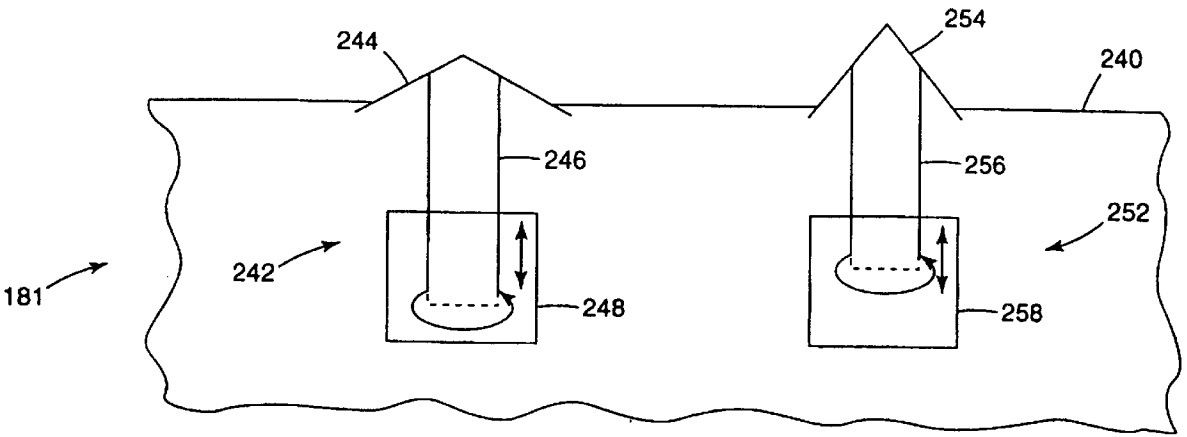
FIG. 11 is an illustration of a boring tool which includes two adjustable cutting bits which may be adjusted in terms of displacement height and/or angle relative to the boring tool housing surface for purposes of enhancing boring tool productivity, steering or improving the wearout characteristics of the cutting bit in accordance with an embodiment of the present invention.

The machine controller 74 may also dynamically adjust the physical configuration of the boring tool 181 to alter boring tool steering and/or productivity characteristics. The portion 240 of a boring tool housing depicted in FIG. 11 includes two cutting bits 244, 254 which may be situated at a desired location on the boring tool 181, it being understood that more or less than two cutting bits may be employed. Each of the cutting bits 244, 254 may be adjusted in terms of displacement height and/or angle relative to the boring tool housing surface 240. The cutting bits 244, 254 may also be rotated to expose particular surfaces of the cutting bit (e.g., unworn portion) to the soil/rock subjected to excavation. A bit actuator 248, 258 responds to hydraulic, mechanical, or electrical control signals to dynamically adjust the position and/or orientation of the cutting bits 244, 254 during a boring operation. The machine controller 74 may control the movement of the cutting bits 244, 254 for purposes of enhancing boring tool productivity, steering or improving the wearout characteristics of the cutting bits 244, 254.

Figure 12:
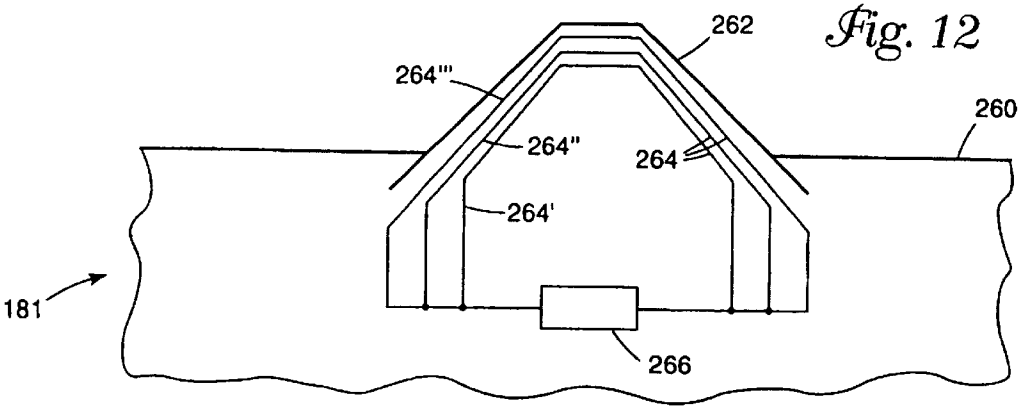
FIG. 12 illustrates a cutting bit of a boring tool which includes one or more integral wear sensors situated at varying depths within the cutting bit for sensing the wearout condition of the cutting bit according to an embodiment of the present invention.

The machine controller 74 may also obtain cutting bit wear data through use of a sensing apparatus provided in the boring tool 181. In the embodiment shown in FIG. 12, a cutting bit 262 comprises a number of integral sensors 264 situated at varying depths within the cutting bit 262. As the cutting bit 262 wears during usage, an uppermost sensor 264''' becomes exposed. A detector 266 detects the exposed condition of sensor 264''' and transmits a corresponding cutting bit status signal to the machine controller 74. As the cutting bit 262 is subjected to further wear, intermediate wear sensor 264'' becomes exposed, causing detector 266 to communicate a corresponding cutting bit status signal to the machine controller 74. When the lowermost sensor 264' becomes exposed due to continued wearing of cutting bit 262, detector 266 communicates a corresponding cutting bit status signal to the machine controller 74, at which point a warning signal indicating detection of an excessively worn cutting bit 262 is transmitted by the machine controller 74 to the central processor 72 and ultimately to the operator. The wear sensors 264 may constitute respective insulated conductors in which a voltage across or current passing therethrough changes as the insulation is worn through. Such a change in voltage and/or current is detected by the detector 266.

Each of the cutting bits 262 provided on the boring tool 181 may be provided with a single wear sensor or multiple wear sensors 264. The detector 266 associated with each of the cutting bits 262 may transmit a unique cutting bit status signal that identifies the particular cutting bit and its associated wear data. In the case of multiple wear sensors 264 provided for individual cutting bits 262, the detector 266 associated with each of the cutting bits 262 transmits a unique cutting bit status signal that identifies the affected cutting bit and wear sensor associated with the wear data. This data may be used by the machine controller 74 to modify the configuration, orientation, and/or productivity of the boring tool 181 during a given boring operation.

Figure 13:
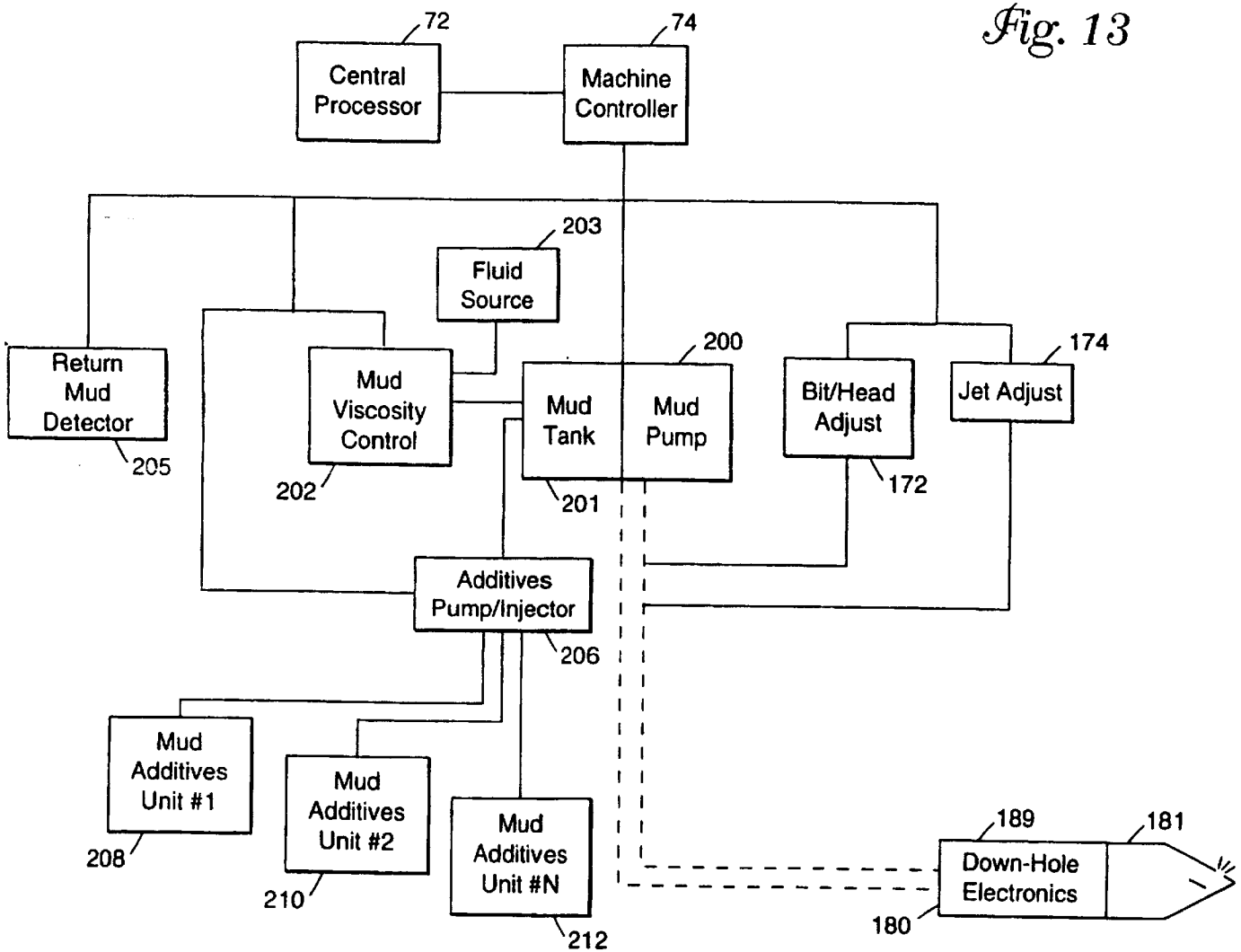
FIG. 13 is a detailed block diagram of a control system for controlling the delivery, composition, and viscosity of a fluid delivered to a boring tool during a drilling operation according to an embodiment of the present invention.

Referring now to FIG. 13, there is depicted a block diagram of a control system for controlling the delivery of a fluid, such as water, mud, foam, air or other fluid composition, to a boring tool 181 during a boring operation, such fluids being referred to herein generally as mud for purposes of clarity. In accordance with this embodiment, the machine controller 74 controls the delivery, viscosity, and composition of mud supplied through the drill string 180 and to boring tool 181. A mud tank 201 defines a reservoir of mud which is supplied to the drill string 180 under pressure provided by a mud pump 200. The mud pump 200 receives control signals from the machine controller 74 which, in response to same, modifies the pressure and/or flow rate of mud delivered through the drill string 180.

Automatic closed-loop control of the mud pump 200 is provided by the machine controller 74 in cooperation with various sensors that sense the productivity of the boring tool and boring machine as discussed above. Mud is pumped through the drill pipe 180 and boring tool 181 or backreamer (not shown) so as to flow into the borehole during respective drilling and reaming operations. The fluid flows out from the boring tool 181, up through the borehole, and emerges at the ground surface. The flow of fluid washes cuttings and other debris away from the boring tool 181 or reamer, thereby permitting the boring tool 181 or reamer to operate unimpeded by such debris. The rate at which fluid is pumped into the borehole by the mud pump 200 is typically dependent on a number of factors, including the drilling rate of the boring machine and the diameter of the boring tool 181 or backreamer. If the boring tool 181 or reamer is displaced at a relatively high rate through the ground, for example, the machine controller 74, typically in response to a control signal received from the central processor 72, transmits a signal to the mud pump 200 to increase the volume of fluid dispensed by the mud pump 200.

It will be understood that the various computations, functions, and control aspects described herein may be performed by the machine controller 74, the central processor 72, or a combination of the two controllers 74, 72. It will be further understood that the operations performed by the machine controller 74 as described herein may be performed entirely by the central processor 72 alone or in cooperation with one or more other local or remote processors.

The machine controller 74 and/or central processor 72 may optimize the process of dispensing mud into the borehole by monitoring the rate of boring tool or backreamer displacement and computing the material removal rate as a result of such displacement. For example, the rate of material removal from the borehole, measured in volume per unit time, can be estimated by multiplying the displacement rate of the boring tool 181 by the cross-sectional area of the borehole produced by the boring tool 181 as it advances through the ground. The machine controller 74 or central processor 72 calculates the estimated rate of material removed from the borehole and the estimated flow rate of fluid to be dispensed through the mud pump 200 in order to accommodate the calculated material removal rate. The central processor 72 may also multiply the volume obtained from the above calculations by the mud volume-to-hole volume ratio selected by the operator for the soil/rock in the current soil strata. This can also be performed automatically based upon the soil/rock data received from the GPR and/or other sensors. For example, a course sandy soil may require a mud-to-hole volume ratio of 5, in which case the amount of mud pumped into the hole is 5 times the hole volume.

A fluid dispensing sensor (not shown) detects the actual flow rate of fluid through the mud pump 200 and transmits the actual flow rate information to the machine controller 74 or central processor 72. The machine controller 74 or central processor 72 then compares the calculated liquid flow rate with the actual liquid flow rate. In response to a difference 110 therebetween, the machine controller 74 or central processor 72 modifies the control signal transmitted to the mud pump 200 to equilibrate the actual and calculated flow rates to within an acceptable tolerance range.

The machine controller 74 or central processor 72 may also optimize the process of dispensing fluid into the borehole for a back reaming operation. The rate of material removal in the back reaming operation, measured in volume per unit time, can be estimated by multiplying the displacement rate of the boring tool 181 by the cross-sectional area of material being removed by the reamer. The cross-sectional area of material being removed may be estimated by subtracting the cross-sectional area of the reamed hole produced by the reamer advancing through the ground from the cross-sectional area of the borehole produced in the prior drilling operation by the boring tool 181.

In a procedure similar to that discussed in connection with the drilling operation, the machine controller 74 or central processor 72 calculates the estimated rate of material removed from the reamed hole and the estimated flow rate of liquid to be dispensed through the liquid dispensing pump 58 in order to accommodate the calculated material removal rate. The fluid dispensing sensor detects the actual flow rate of liquid through the mud pump 200 and transmits the actual flow rate information to the machine controller 74 or central processor 72, which then compares the calculated liquid flow rate with the actual liquid flow rate. In response to a difference therebetween, the machine controller 74 or central processor 72 modifies the control signal transmitted to the mud pump 200 to equilibrate the actual and calculated flow rates to within an acceptable tolerance range.

In accordance with an alternative embodiment, the machine controller 74 or central processor 72 may be programmed to detect simultaneous conditions of high thrust/pullback pump pressure and low rotation pump pressure, detected by sensors 152 and 162 respectively shown in FIG. 8. Under these conditions, there is an increased probability that the boring tool 181 is close to seizing in the borehole. This anomalous condition is detected when the pressure of the thrust/pullback pump 144 detected by sensor 152 exceeds a first predetermined level, and when the pressure of the rotation pump 146 detected by sensor 162 falls below a second predetermined level. Upon detecting these pressure conditions simultaneously, the machine controller 74 or central processor 72 may increase the mud flow rate by transmitting an appropriate signal to the mud pump 200 and thus prevent the boring tool 181 from seizing. Alternatively, the machine controller 74 or central processor 72 may be programmed to reduce the displacement rate of the boring tool 181 when the conditions of high thrust/pullback pump pressure and low rotation pump pressure exist simultaneously, as determined in the manner described above.

As is further shown in FIG. 13, the machine controller 74 may also control the viscosity of fluid delivered to the boring tool 181. The machine controller 74 communicates control signals to a mud viscosity control 202 to modify mud viscosity. Mud viscosity control 202 regulates the flow of a thinning fluid, such as water, received from a fluid source 203. Fluid source 203 may represent a water supply, such as a municipal water supply, or a tank or other stationary or mobile fluid supply. The viscosity of the mud contained in the mud tank 201 may be reduced by increasing the relative volume of thinning fluid contained into the mud tank 201. In this case, the machine controller 74 transmits a control signal to the mud viscosity control 202 to increase to thinning fluid volume delivered to the mud tank 201 until the desired viscosity is achieved.

The viscosity of the mud contained in the mud tank 201 may be increased by increasing the relative volume of solids contained into the mud tank 201. The machine controller 74 controls an additives pump/injector 206 which injects a solid or slurry additive into the mud tank 201. In one embodiment, the contents of the mud tank 201 are circulated through the mud viscosity control 202 and additives pump/injector 206 such that thinning fluid and/or solid additives may be selectively mixed into the circulating mud mixture during the mud modification process to achieve the desired mud viscosity and composition.

In accordance with another embodiment, and with continued reference to FIG. 13, the composition of the mud contained in the mud tank 201 and delivered to the boring tool 181 may be altered by selectively mixing one or more additives to the mud tank contents. It is understood that soil/rock characteristics can vary dramatically among excavation sites and among locations within a single excavation site. It may be desirable to tailor the composition of mud delivered to the boring tool 181 to the soil/rock conditions at a particular boring site or at particular locations within the boring site. A number of different mud additives, such as powders, may be selectively injected into the mud tank 201 from a corresponding number of mud additive units 208, 210, 212.

Upon determining the soil or rock characteristics either manually or automatically in a manner discussed above (e.g., using GPR imaging or other geophysical sensing techniques), the machine controller 74 controls the additives pump/injector 206 to select and deliver an appropriate mud additive from one or more of the mud additive units 208, 210, 212. Since the soil/rock characteristics may change during a boring operation, the mud additives controller may adaptively deliver appropriate mud additives to the mud tank 201 or an inlet downstream of the mud tank 201 to enhance the boring operation.

The presence or lack of mud exiting a borehole may also be used as a control system input which may be evaluated by the machine controller 74. A return mud detector 205 may be situated at the entrance pit location and used to determine the volume and composition of mud/cutting return coming out of the borehole. A spillover vessel may be placed near the entrance pit and preferably situated in a dug out section such that some of the mud exiting the borehole will spill into the spillover vessel. The return mud detector 205 may be used to detect the presence or absence of mud in the spillover vessel during a boring operation. If mud is not detected in the spillover vessel, the machine controller 74 increases the volume of mud introduced into the borehole.

The volume of mud may also be estimated using a flow meter and the cross-sectional dimensions of the borehole. If the volume of return mud is less than desired, the machine controller 74 may increase the volume of mud introduced into the borehole until the desired return mud volume is achieved. The cuttings coming out the borehole may also be analyzed, the results of which may be used as an input to the boring control system. An optical sensor, for example, may be situated at the borehole entrance pit location for purposes of analyzing the size of the cuttings. The size of the cuttings exiting the borehole may be used as a factor for determining whether the boring tool is operating as intended in a given soil/rock type. Other characteristics of the cutting returns may be analyzed.

Figure 14:
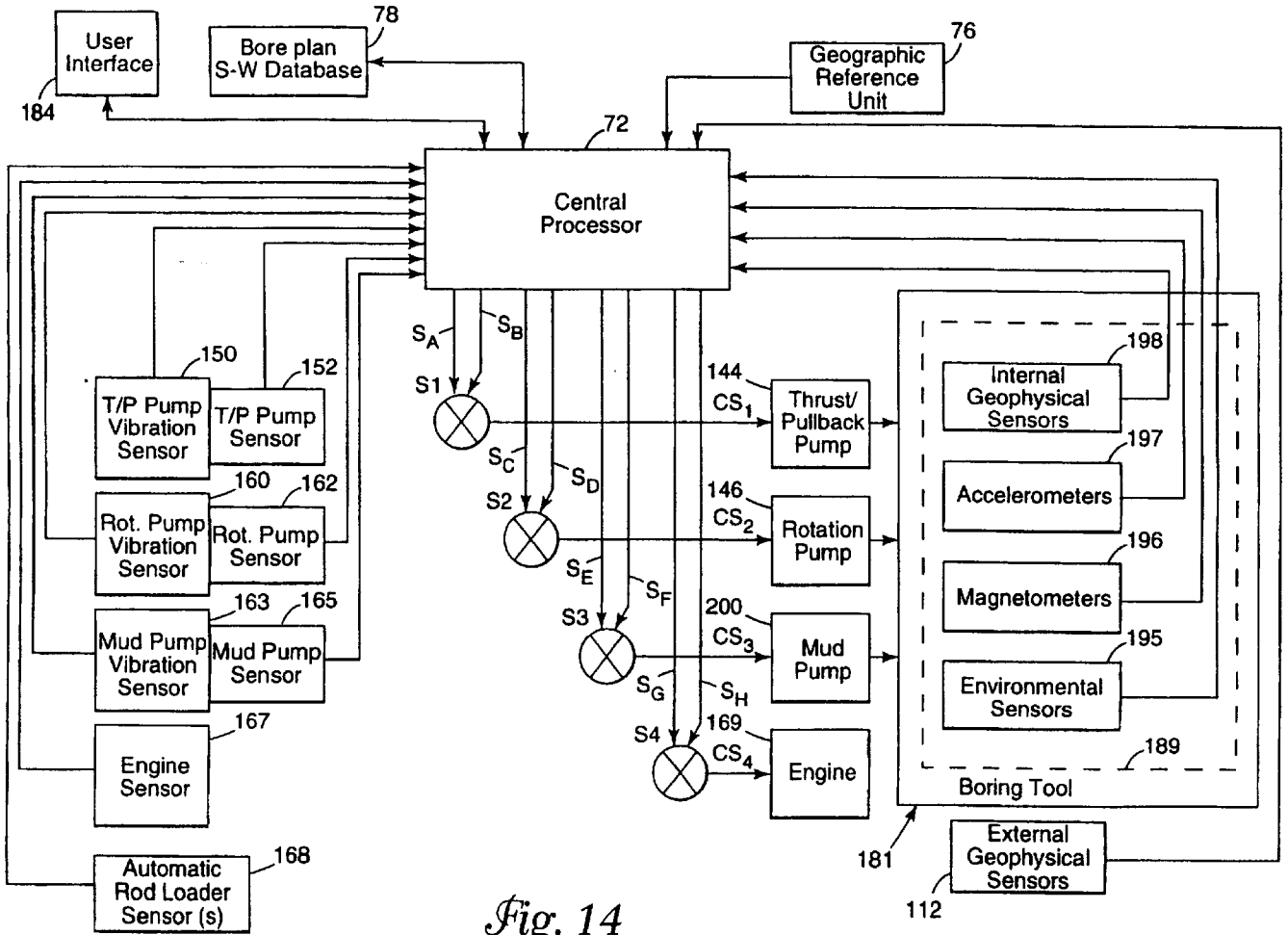
FIG. 14 is a more detailed depiction of a control system for controlling boring machine operations in accordance with an embodiment of the present invention.

Referring now to FIG. 14, there is illustrated a block diagram showing the direction of sense and control signals through a close-loop, real-time boring control system according to an embodiment of the present invention. According to this embodiment, the central processor 72 receives a number of inputs from various sensors provided within the down-hole sensor unit 189 of a boring tool 181 and various sensors provided on the boring machine pumps, engines, and motors. The central processor 72 also receives data from a bore plan software and database facility 78, a geographic reference unit 76, geophysical sensors 112, and a user interface 184. Using these data and signal inputs, the central processor 72 optimizes boring machine/boring tool productivity while excavating along a pre-planned bore path and, if necessary, computes an on-the-fly alternative bore plan so as to minimize drill string/boring tool/boring machine stress and to avoid contact with buried hazards, obstacles and undesirable geology.

By way of example, the central processor 72 may modify a given pre-planned bore plan upon detecting an appreciable change in boring tool steering behavior. A steerability factor may be assigned to a given pre-planned bore path. The steerability factor is an indication of how quickly the boring tool can change direction (i.e., steer) in a given geology, and may be expressed in terms of rate of change of boring tool pitch or yaw as the boring tool moves longitudinally. If the soil/rock steerability factor indicates that the actual drill string curvature will be flatter than the planned curvature, which generally results in lower drill string stress, the central processor 72 may modify the pre-planned bore path accordingly so that critical underground targets can be drilled through.

As is shown in FIG. 14, the central processor 72 receives input signals from the various sensors of the boring tool down-hole sensor unit 189, which may include one or more geophysical sensors 198, accelerometers 197, magnetometers 196, and one or more environmental sensors 195. The sensor input signals are preferable acquired by the central processor 72 in real-time. The central processor 72 also receives input signals from the thrust/pullback pump pressure and vibration sensors 152, 150, rotation pump pressure and vibration sensors 162, 160, mud pump pressure and vibration sensors 165, 163, and other vibration sensors that may be mounted to the boring machine structure/chassis. An input signal produced by an engine sensor 167 is also received by the central processor 72. User input commands are also received by the central processor 72 via a user interface 184. The central processor 72 also receives input data from one or more automatic rod loader sensors 168.

In response to these input signals, operator input signals, and in accordance with a selected bore plan, the central processor 72 controls boring machine operations to produce the desired borehole along the intended bore path as efficiently and productively as possible. In controlling the thrust/pullback pump 144, for example, the central processor 72 produces a primary control signal, $S_A$, which is representative of a requested level of thrust/pullback pump output (i.e., pressure). The primary control signal, $S_A$, may be modified by a compensation signal, $S_B$, in response to the various boring tool and boring machine sensor input signals received by the central processor 72.

The process of modifying the primary control signal, $S_A$, by use of the compensation signal, $S_B$, is depicted by a signal summing operation performed by a signal summer S1. At the output of the signal summer S1, a thrust/pullback pump control signal, $CS_1$, is produced. The thrust/pullback pump control signal, $CS_1$, is applied to the thrust/pullback pump 144 to effect a change in thrust/pullback pump output. It is noted that the compensation signal, $S_B$, may have an appreciable effect or no effect (i.e., zero value) on the primary control signal, $S_A$, depending on the sensor input and bore plan data being evaluated by the central processor 72 at a given moment.

The central processor 72 also produces a primary control signal, $S_C$, which is representative of a requested level of rotation pump output, which may be modified by a compensation signal, $S_D$, in response to the various boring tool and boring machine sensor input signals received by the central processor 72. A rotation pump control signal, $CS_2$, is produced at the output of the signal summer S2 and is applied to the rotation pump 146 to effect a change in rotation pump output.

In a similar manner, the central processor 72 produces a primary control signal, $S_E$, which is representative of a requested level of mud pump output, which may be modified by a compensation signal, $S_F$, in response to the various boring tool and boring machine sensor input signals received by the central processor 72. A mud pump control signal, $CS_3$, is produced at the output of the signal summer S3 and is applied to the mud pump 200 to effect a change in mud pump output.

The central processor 72 may also produce a primary control signal, $S_G$, which is representative of a requested level of boring machine engine output, which may be modified by a compensation signal, $S_H$, in response to the various boring tool and boring machine sensor input signals received by the central processor 72. An engine control signal, $CS_4$, is produced at the output of the signal summer S4 and is applied to the engine 169 to effect a change in engine performance.

Figure 16:
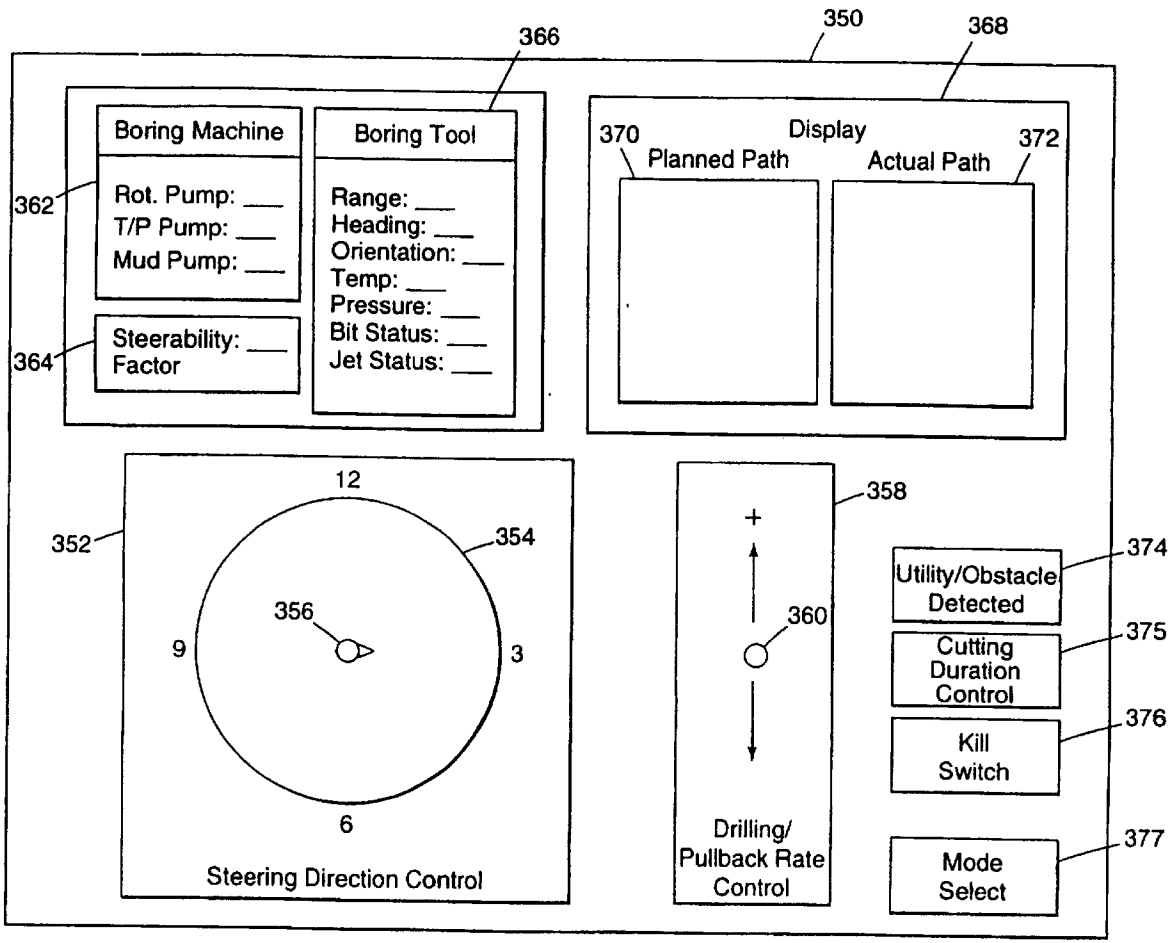
FIG. 16 is a depiction of a portable remote unit for controlling boring machine activities from a site remote from the boring machine in accordance with an embodiment of the present invention.
Figure 17:
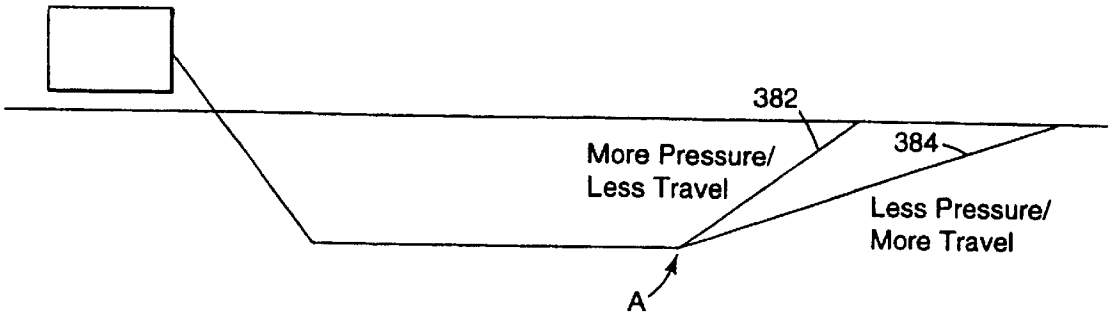
FIG. 17 illustrates two modes of steering a boring tool in accordance with an embodiment of the present invention.

In accordance with another embodiment of the present invention, and with reference to FIGS. 15–17, a remote control unit provides an operator with the ability to control all or a sub-set of boring system functions and activities. According to this embodiment, an operator initiates boring machine and boring tool commands using a portable control unit, an embodiment of which is depicted in FIG. 16. Referring to FIG. 15A, there is illustrated a diagram which depicts the flow of various signals between a remote unit 304 and a horizontal directional drilling (HDD) machine 302. According to this system configuration, which represents a less complex implementation, the boring tool 181 is of a conventional design and includes a transmitter 308 for transmitting a sonde signal. The transmitter 308 may alternatively be configured as a transceiver for receiving signals from the remote unit 304 in addition to transmitting sonde signals.

In one embodiment, the remote unit 304 has standard features and functions equivalent to those provided by conventional locators. The remote unit 304 also includes a transceiver 306 and various controls that cooperate with the transceiver 306 for sending boring and steering commands 312 to the HDD 302. The remote unit 304 may include all or some of the controls and displays depicted in FIG. 16, which will be described in greater detail hereinbelow. The HDD 302 includes a transceiver (not shown) for receiving the boring/steering commands 312 from the remote unit 304 and for sending HDD status information 310 to the remote unit 304. The HDD status information is typically presented on a display provided on the remote unit 304. The HDD 302 incorporates a central processor and associated interfaces to implement boring and steering changes in response to the control signals received from the remote unit 304.

FIG. 15B illustrates a more complex system configuration which provides an operator the ability to communicate with down-hole electronics provided within or proximate the boring tool 181. According to one system configuration, the remote unit 324 has standard features and functionality equivalent to those provided by conventional locators. In addition, the remote unit 324 includes a transceiver 326 which transmits and receives electromagnetic (EM) signals. The transceiver 326 of the remote unit 324 transmits boring and steering commands 333 to the down-hole electronics which are received by the transceiver 328 of the boring tool 181.

The down-hole electronics process the boring and steering commands and, in response, communicate the commands to the HDD 322 to implement boring and steering changes. In one embodiment, the boring tool electronics relay the boring/steering command received from the remote unit 324 essentially unchanged to the HDD 322. In another embodiment, the down-hole electronics process the boring/steering command and, in response, produce HDD control signals which effect the necessary changes to boring machine/boring tool operation.

The boring tool commands may be communicated from the boring tool 181 to the HDD 322 via a wire-line 331 or wireless communication link 330, 332. The wireless communication link 330, 332 may be established via the remote unit 324 or other transceiving device. The HDD 322 communicates HDD status information to the remote unit 324 via a wire-line communication link 336, 338 or a wire-less communication link 334. It is understood that a communication link established via the drill string may incorporate a physical wire-line, but may also be implemented using other transmission means, such as those described herein and those known in the art.

A variation of the embodiment depicted in FIG. 15B provides for the above-described functionality and, in addition, provides the capability to dynamically modify the boring tool steering commands received from the remote unit 324. The data acquired and produced by the down-hole sensor unit of the boring tool 181 may be processed by the down-hole electronics and used to modify the boring/steering commands received from the remote unit 324. The down-hole electronics, for example, may generate or alter mud pump and thrust/pullback pump commands, in addition to rotation pump commands, in response to boring/steering commands 333 received from the remote unit 324 and other data obtained from various navigation and geophysical sensors. The down-hole electronics may also produce local control signals that modify the various steering mechanisms of the boring tool, such as fluid jet direction and orifice size, steering plate/duckbill angle of attack, articulated head angle and/or direction, bit height and angle, and the like.

By way of further example, an in-tool or above-ground GPR unit may detect the presence of an obstruction several feet ahead of the boring tool. The GPR data representative of the detected obstruction is typically presented to the operator on a display of the remote unit 324. The operator may issue steering commands to the boring tool 181 in order to avoid the obstruction. In response to the steering commands, the down-hole electronics may further modify the operator issued steering commands based on various data to ensure that the obstruction is avoided. For example, the operator may issue a steering command that may cause avoidance of an obstruction, but not within a desired safety margin (e.g., 2 feet). The down-hole electronics, in this case, may modify the operator issued steering commands so that the obstruction is avoided in a manner that satisfies the minimum safety clearance requirement associated with the particular obstruction.

Turning now to FIG. 16, there is depicted an embodiment of a remote unit 350 that may be used by an operator to control all or a sub-set of boring machine functions that affect the productivity and steering of the boring tool during a boring operation. According to this embodiment, the remote unit 350 includes a steering direction control 352 with which the operator controls boring tool orientation and rate of boring tool rotation. The steering direction control 352 may include a joystick 356 which is moved by the operator to direct the boring tool in a desired heading. The steering direction control 352 includes a clock face display 354 with appropriate hour indicators. The operator moves the steering direction joystick 356 to a desired clock position, such as a 3:00 position, typically by rotating the joystick about its axis to the desired position.

The joystick may also be moved in a forward and reverse direction at a given clock position to vary the boring tool rotation rate as desired. In response to a selected joystick position and displacement, the boring machine provides the necessary rotation and thrust to modify the present boring tool location and orientation so as to move the boring tool to the requested position/heading at the requested degree of steepness. It is understood that other steering related processes may also be adjusted using the remote unit 350 to achieve a desired boring tool heading, such as mud flow changes, fluid jet and steering surface changes, and the like.

The remote unit 350 further includes a drilling/pullback rate control 358 for controlling the amount of force applied to the drill string in the forward and reverse directions, respectively. Alternatively, drilling/pullback rate control 358 controls the thrust speed of the drill string in the forward and reverse directions, respectively. The drilling/pullback rate control 358 includes a lever control 360 that is movable in a positive and negative direction to effect forward and reverse displacement changes at variable thrust force/speed levels. Moving the lever control 360 in the positive (+) direction results in forward displacement of the boring tool at progressively increasing thrust force/speed levels. Moving the lever control 360 in the negative (−) direction results in reverse displacement (i.e., pullback) of the boring tool at progressively increasing thrust force/speed levels.

The drilling/pullback rate control 358, as well as the steering direction control 352, may be operable in one of several different modes, such as a normal drilling mode and a creep mode. A mode select switch 377 may be used to select a desired operating mode. A creep mode of operation allows the remote operator to slowly and safely displace and rotate the boring tool at substantially reduced rates. Such reduced rates of rotation and displacement may be required when steering the boring tool around an underground obstruction or when operating near or directly with the boring tool, such as at an exit location. It is understood that the control features and functionality described with reference to the remote unit 350 may be incorporated at the boring machine for use in locally controlling a boring operation.

FIG. 17 illustrates two boring tool steering scenarios that may be achieved using the remote unit 350 shown in FIG. 16. The boring tool is moved along an underground path to a target location A at which point the boring tool is steered toward the surface at two distinctly different angles of assent. Bore path 382 represents a steeper and shorter route to the earth's surface relative to bore path 384, which is shown as a more gradual and longer route. Starting at location A, the steeper bore path 382 may be achieved by displacing the steering direction joystick 356 in a direction toward the periphery of the circular clock display 354. Higher levels of thrust displacement or other steering actuation are achieved in response to greater displacement of the joystick 356 outwardly from a neutral (i.e., non-displaced)

position toward the periphery of the circular clock display 354. The more gradual bore path 384 may be achieved by leaving the joystick 356 near its neutral or non-displaced position. Lower levels of thrust displacement or other steering actuation are achieved in response to minimal or zero displacement of the joystick 356 relative to its neutral position.

In accordance with another embodiment, steering of the boring tool may be accomplished in one of several steering modes, including a hard steering mode and a soft steering mode. Both of these steering modes are assumed to employ the rotation and thrust/pullback pump control capabilities previously described above with reference to co-owned U.S. Pat. No. 5,746,278. According to a hard steering mode, positioning of the joystick 356 allows the operator to modulate the thrust pump pressure during the cut. In particular, the boring tool is thrust forward until the thrust/pullback pump pressure limit, as dictated by the preset joystick 356 position, is met, at which time the boring tool is rotated in the prescribed manner as indicated by the cutting duration. The cutting duration refers to the number of clock-face segments the boring tool will sweep through. The cutting duration is set by use of a cutting duration control 375 provided on the remote unit 350. This process is repeated until the selected boring tool heading is achieved.

In accordance with a soft steering mode, positioning of the joystick 356 allows the operator to modulate the distance of boring tool travel before it is rotated by the prescribed amount as indicated by the cutting duration. In particular, the boring tool is thrust forward for a pre-established travel distance, and, simultaneously, the boring tool is rotated through the cutting duration. This process is repeated until the desired boring tool heading is achieved.

In accordance with another steering mode of the present invention which employs a rockfire cutting action, the boring tool 24 is thrust forward until the boring tool begins its cutting action. Forward thrusting of the boring tool continues until a preset pressure for the soil conditions is met. The boring tool is then rotated clockwise through the cutting duration while maintaining the preset pressure. In the context of a rockfire cutting technique, the term pressure refers to a combination of torque and thrust on the boring tool. Clockwise rotation of the boring tool is terminated at the end of the cutting duration and the boring tool is pulled back until the pressure at the boring tool is zero. The boring tool is then rotated clockwise to the beginning of the duration. This process is repeated until the desired boring tool heading is achieved.

In accordance with another embodiment of a steering mode which employs a rockfire cutting action, the boring tool 24 is thrust forward until the boring tool begins its cutting action. Forward thrusting of the boring tool continues until a preset pressure for the soil conditions is met. The boring tool is then rotated clockwise through the cutting duration while maintaining the preset pressure. Clockwise rotation of the boring tool is terminated at the end of the cutting duration. The boring tool is then rotated counterclockwise while maintaining a torque that is about 60% less than the makeup torque required for the drill rod in use. If the torque is too large, counterclockwise rotation of the boring tool is reduced or terminated and the boring tool is pulled back until about 60% of the makeup torque is reached. Counterclockwise rotation of the boring tool continues until the beginning of the cutting duration. The process is repeated until the desired boring tool heading is achieved.

In accordance with yet another advanced steering capability, the torsional forces that act on the drill string during a drilling operation are accounted for when steering the boring tool. It is well-understood in the art of drilling that residual rotation of the boring tool occurs after ceasing rotation of the drill string at the drilling machine due to a torsional spring affect commonly referred to as torsional wind-up or pipe wrap. The degree to which residual boring tool rotation occurs due to torsional wind-up is determined by a number of factors, including the length and diameter of the drill string, the torque applied to the drill string by the boring machine, and drag forces acting on the drill string by the particular type of soil/rock surrounding the drill string.

When steering a boring tool to follow a desired heading, a common technique used to steer the boring tool involves rotating the tool to a selected orientation needed to effect the steering change, ceasing rotation of the tool at the selected orientation, and then thrusting the boring tool forward. This process is repeated to achieve the desired boring tool heading. Given the effects of torsional wind-up, however, it can be appreciated that stopping the rotating boring tool at a desired orientation is difficult. Conventional steering approaches require the use of a portable locator to confirm that the boring tool is properly oriented prior to applying thrust forces to the boring tool. The remote operator must cooperate with the boring machine operator to ensure that the boring tool is neither under-rotated or over-rotated prior to the application of thrust forces. The process of manually assessing and confirming the orientation of the boring tool to effect heading changes is time consuming and costly in terms of operator resources.

An adaptive steering approach according to the present invention characterizes the torsional wind-up behavior of a given drilling string and updates this characterization as the drill string is adjusted in terms of length and curvature. Using the acquired wind-up characterization data, the boring tool may be rotated to the desired orientation without the need for operator intervention. For example, torsional wind-up at a particular boring tool location may account for residual rotation of 80 degrees. Earlier acquired data may indicate that the rate of wind-up has been increasing substantially linearly at a rate of 1 degree per 20 feet of additional drill string length. Based on these data, the residual rotation of the boring tool at the next turning location may be estimated using an appropriate extrapolation algorithm. It is understood that the degree of wind-up may increase in a non-linear manner as function of additional drill string length, and that an appropriate non-linear extrapolation algorithm should be applied to the data in this case. In this illustrative example, it is assumed that the estimated residual rotation that will occur at the next turning location is computed to be 84 degrees. The estimated residual rotation may be accounted for at the drilling machine, such that the boring machine ceases drill string rotation to allow the boring tool to rotate an additional 84 degrees to the intended orientation needed to effect the steering change. If, for example, over-rotation occurs at the next turning location due to unexpected changes in soil/rock composition, the historical and current torsional wind-up characterization data may be used to cause to the drilling machine to rotate the boring tool to the proper orientation in view of the changed soil/rock characteristics (e.g., actual torsional wind-up resulted in 88 degrees of residual boring tool rotation, instead of the estimated 86 degrees of residual rotation due to unexpected increase in soil/rock drag forces).

It will be appreciated that the torsional wind-up behavior of a given drill string may be characterized in other ways, such as by use of velocity and/or acceleration profiles. By way of example, an acceleration or velocity profile may be developed that characterizes the change of drill string rotation during torsional wind-up. In particular, the acceleration or velocity of the drill string between the time the drilling machine ceases to rotate the drill string and the time when residual boring tool rotation ceases may be characterized to develop wind-up acceleration/velocity profile data. These data may be used to estimate the torsional wind-up behavior of the drill string at a given turning location so that the boring tool rotates to the desired orientation after residual rotation of the boring tool ceases.

An adaptive approach may also be employed when initiating rotation of the drill string, and is of particular use when reinitiating rotation of a relatively long drill string. Characterizing the initial drill string rotation behavior allows for a high degree of control when making small, slow changes to boring tool rotation. Such a control capability is desirable when operators are working on or closely to the boring tool. A rotation sensor may be used to determine how far the gearbox of the rotation unit rotates before the boring tool rotates. This differential in gearbox and boring tool rotation results from torsional wind-up effects as discussed above. This differential may be monitored and compensated for when initiating drill string rotation to rotate the boring tool to a desired orientation.

With continued reference to FIG. 16, a warning indicator 374 may be provided to alert the operator as to an impending collision situation. The warning indicator 374 may be an illuminatable indicator, a speaker that broadcasts an audible alarm or a combination of visual and audible indicators. A kill switch 376 is provided to allow the operator to terminate all drilling related activities when appropriate. A mode select switch 377 provides for the selection of one of a number of different operating modes, such as a normal drilling mode, a creep mode, a backreaming mode, and transport mode, for example.

Several displays are provided on the remote unit 350. Various data concerning boring machine status and activity are presented to the operator on a boring machine status display 362. Various data concerning the status of the boring tool are presented to the operator via a boring tool status display 366. Boring tool steerability factor data may also be displayed within an appropriate display window 364. Planned and actual bore path data may be presented on appropriate displays 370, 372. It is understood that the type of data displayable on the remote unit 350 may vary from that depicted in FIG. 16. For example, GPR imaging data or other geophysical sensor data may be graphically presented on an appropriate display, such as imaging data associated with man-made and geologic structures. Also, it is appreciated that the various displays depicted in FIG. 16 may constitute physically distinct display devices or individual windows of a single display.

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth below and equivalents thereof.

What is claimed is:

1. An underground drilling device for use with an above-ground locator, comprising:

a cutting tool assembly comprising a cutting tool and a sensor housing;

a radar unit provided in the sensor housing;

a transmitter provided in the sensor housing; and a processor provided in the sensor housing and communicatively coupled to the radar unit and the transmitter, the processor receiving radar data from the radar unit and producing sensor data for transmission via the transmitter in a form suitable for reception by the above-ground locator.

2. The device of claim 1, wherein the processor communicates with the aboveground locator via a wireless link.

3. The device of claim 1, wherein the processor communicates with the aboveground locator via a hardwire link.

4. The device of claim 3, wherein the processor communicates with the aboveground locator via (1) a hardwire link to a drilling machine to which the underground drilling device is coupled and (2) a wireless link from the drilling machine to the above-ground locator.

5. The device of claim 1, wherein a multiple-axis magnetometer is provided in the sensor housing.

6. The device of claim 1, wherein a multiple-axis accelerometer is provided in the sensor housing.

7. The device of claim 1, wherein a gas sensor is provided in the sensor housing.

8. The device of claim 1, wherein an acoustic sensor, a seismic sensor, or an ultrasonic sensor is provided in the sensor housing.

9. The device of claim 1, wherein a resistive sensor or a capacitive sensor is provided in the sensor housing.

10. The device of claim 1, wherein a vibration sensor, a temperature sensor or a pressure sensor is provided in the sensor housing.

11. The device of claim 1, wherein a magnetic or electromagnetic sonde is provided in the sensor housing.

12. The device of claim 1, wherein the radar data comprises object detection data indicative of an object in proximity to the cutting tool assembly, and the processor produces an alert signal in response to the object detection data.

13. The device of claim 1, wherein the sensor data produced by the processor comprises geophysical data indicative of geology in proximity to the cutting tool assembly.

14. The device of claim 1, wherein the sensor data represents radar data at least partially processed by the processor.

15. The device of claim 1, wherein the sensor data represents substantially unprocessed radar data.

16. The device of claim 1, further comprising a receiver provided in the sensor housing.

17. A method of sensing at an underground drilling device in communication with an above-ground locator, comprising:

transmitting a radar probe signal from the underground drilling device;

receiving a radar return signal at the underground drilling device;

processing the radar return signal at the underground drilling device to produce sensor data; and transmitting the sensor data in a form suitable for reception by the aboveground locator.

18. The method of claim 17, wherein transmitting the sensor data comprises transmitting the sensor data to the above-ground locator via a wireless link.

19. The method of claim 17, wherein transmitting the sensor data comprises transmitting the sensor data to the above-ground locator via a hardwire link.

20. The method of claim 17, wherein transmitting the sensor data comprises transmitting the sensor data to the above-ground locator via (1) a hardwire link to a drilling machine to which the underground drilling device is coupled and (2) a wireless link from the drilling machine to the above-ground locator.

21. The method of claim 17, further comprising displaying the sensor data at the above-ground locator.

22. The method of claim 17, further comprising transmitting the sensor data from the above-ground locator to a drilling machine to which the underground drilling device is coupled.

23. The method of claim 22, further comprising displaying the sensor data at the drilling machine.

24. The method of claim 17, wherein the sensor data further comprises magnetometer data.

25. The method of claim 17, wherein the sensor data further comprises accelerometer data.

26. The method of claim 17, wherein the sensor data further comprises gas sense data.

27. The method of claim 17, wherein the sensor data further comprises temperature data or pressure data.

28. The method of claim 17, further comprising detecting an object in proximity to the underground drilling device using the radar return signal.

29. The method of claim 17, further comprising detecting one or more geophysical characteristics of earth in proximity to the underground drilling device using the radar return signal.

30. The method of claim 17, wherein the sensor data represents at least partially processed radar return signal data.

31. The method of claim 17, wherein the sensor data represents substantially unprocessed radar return signal data.

32. The method of claim 17, further comprising receiving data transmitted from the above-ground locator at the underground drilling device.

* * * * *